US007059710B2

(12) United States Patent
Ishikawa

(10) Patent No.: US 7,059,710 B2
(45) Date of Patent: Jun. 13, 2006

(54) IMAGE FORMING METHOD, PRINTED MATTER AND IMAGE RECORDING APPARATUS

(75) Inventor: Wataru Ishikawa, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 257 days.

(21) Appl. No.: 10/726,742

(22) Filed: Dec. 3, 2003

(65) Prior Publication Data

US 2004/0113961 A1 Jun. 17, 2004

(30) Foreign Application Priority Data

Dec. 11, 2002 (JP) ..... 2002-359217

(51) Int. Cl.

| | |
|---|---|
| ***B41J 2/045*** | (2006.01) |
| ***B41J 2/04*** | (2006.01) |
| ***B41J 2/05*** | (2006.01) |
| ***B41J 2/01*** | (2006.01) |

(52) U.S. Cl. ..... 347/68; 347/54; 347/57; 347/102

(58) Field of Classification Search ..... 347/11, 347/68, 54, 56, 57, 65

See application file for complete search history.

(56) References Cited

U.S. PATENT DOCUMENTS 5,438,350 A * 8/1995 Kerry ..... 347/12
6,331,040 B1 * 12/2001 Yonekubo et al. ..... 347/15
6,467,897 B1 * 10/2002 Wu et al. ..... 347/102

* cited by examiner

*Primary Examiner*—Lamson Nguyen
*Assistant Examiner*—Jannelle M. Lebron
(74) *Attorney, Agent, or Firm*—Lucas and Merca

(57) ABSTRACT

A method for forming an ink-jet image, comprising the steps of:

(a) ejecting droplets of an ink through ink-nozzles of an ink-jet head of an ink-jet recording apparatus, the ink-jet recording apparatus being provided with a driving signal generator producing: (i) an expansion pulse which expands a volume of the ink chamber by deforming the actuator contained in the dividing wall of the ink chamber; (ii) a shrinkage pulse which compresses the volume of the ink chamber by deforming the actuator; and (iii) a predetermined quiescent period between the expansion pulse and the shrinkage pulse, the quiescent period being regulated so as to decrease the cross talk among the ink chambers adjacent to each other, (b) hardening the droplets of the ink ejected on the recording media via irradiation of an actinic ray, wherein the ink contains a radical polymerization monomer and a radical initiator.

17 Claims, 7 Drawing Sheets

IMAGE FORMING METHOD, PRINTED MATTER AND IMAGE RECORDING APPARATUS

TECHNICAL FIELD

The present invention relates to an image forming method, printed matter and an image recording apparatus which may record images of superior text quality, no color mixing and high-definition, as well as less creasing and curling on printed matter.

BACKGROUND

In recent years, ink-jet recording methods have found wide application in the field of various kinds of graphic arts such as photography, various kinds of printing, marking and specific printing such as color filters due to its ability to form images simply and cheaply. Particularly, it has also become possible to obtain image quality comparable with silver salt photography by utilizing a recording apparatus which ejects and controls minute dots; ink in which color reproduction range, durability and ejection suitability have been improved; and exclusive paper in which ink absorption, color forming property of the colorant and surface gloss have been greatly enhanced. Image quality improvement of current ink-jet recording methods has been achieved only when complete set of a recording apparatus, ink and exclusive paper are employed as a system.

However, an ink-jet system which requires exclusive paper is problematic with respect to limitations of recording media and increased cost of such recording media. Therefore, many attempts have been made to record on a medium, on which ink is to be transferred, differing from exclusive paper by means of ink-jet recording. Specifically, there are phase-conversion ink-jet methods utilizing wax which is solid at room temperature, solvent-type ink-jet methods utilizing an ink which is comprised mainly of a rapid-drying organic solvent, and UV ink-jet methods in which an ink is cross-linked by ultraviolet (UV) light after recording.

Among these, the UV ink-jet methods have been noted recently due to relatively low odor compared to solvent-type ink-jet methods, rapid drying of prints and the capability of recording on a recording medium without ink absorption property; UV-curable ink-jet inks are disclosed (for example, in Patent Documents 1–3).

However, even when these inks are employed, ink dot diameter after deposition may change greatly depending on the kinds of recording medium and working environment, leading to difficulty to form high definition images onto all the kinds of recording media.

On the other hand, as ink-jet recording methods ejecting inks using ink-jet recording heads, well known are a piezo method, a thermal method and a continuous method. Of these, the piezo method using piezoelectric members is widely employed from the viewpoint of ejecting stability. Said piezo method is a method which ejects ink droplets from ink nozzles by changing pressure in ink chambers using actuators such as piezoelectric members which function by deformation actuation based on applied voltages. In general ink-jet Recording Heads, many ink chambers and ink nozzles are provided from the viewpoint of forming high image quality and high-definition images. However, this causes problems such as "cross talk", which means that change of pressure in ink chambers during image formation causes fluctuation in adjacent inks. As a result, accuracy of ink droplet flight decreases to result in hindrance to formation of high-definition images. Specifically, compared to water base ink, it has been proved that this phenomenon is notably observed on the above-mentioned UV curable ink having high viscosity in ink droplets.

As one of the methods to solve the above cross talk, the following improving method is proposed (for example, refer to Patent Document 4). That is, to provide a predetermined quiescent time between an expansion pulse which functions to expand volumes of ink chambers by deformation actuation of actuators comprising ink chamber dividing walls, and a shrinkage pulse which functions to compress volumes of ink chambers by deformation actuation of actuators, to provide a continuous driving signal generation means for multiple times generating driving signals applied to the actuators, to continuously eject plural ink droplets from ink ejecting orifices by repeated expansion and compression of ink chamber volumes during multiple times of the driving signals from a driving signal generation means, and accompanying the above to set up the quiescent time to decrease the cross talk among the ink chambers adjacent to each other. However, in the above invention, there is no description about the characteristics of the ink used.

Further, ink employed in the traditional UV curable ink-jet method has drawbacks, that is, recording media tend to easily shrink with that ink. Specifically, thin plastic films used for flexible packaging, such as food packaging, and pressure sensitive adhesive labels tend to result in shrinkage. As a result, in flexible packaging printing and label printing, the UV curable ink-jet method has not yet been practical in use in the cited situations.

Patent Document 1: Examined Japanese Patent Publication 5-54667

Patent Document 2: Unexamined Japanese Patent Publication 6-200204

Patent Document 2: Japanese Translated PCT Patent Publication 2000-504778

Patent Document 4: Unexamined Japanese Patent Publication 2000-19103 (Claims)

SUMMARY

From the viewpoint of the foregoing, the present invention is being offered. The object is to provide a image forming method, printed matter and an image recording apparatus, which will record images of superior text quality, no color mixing and high-definition, as well as less creasing and curling on printed mater.

The above object of the present invention was achieved employing the following embodiments.

(1) A method for forming an ink-jet image, comprising the steps of:

(a) ejecting droplets of an ink through ink-nozzles of an ink-jet head of an ink-jet recording apparatus, the ink-jet head being provided with:

(i) a plurality of ink chambers having the ink-nozzles, each ink chamber having a dividing wall between adjacent ink chambers, the dividing wall containing an actuator which deforms in response to applied voltages to the adjacent ink chambers; and (ii) a common ink tank which communicates with the ink chambers respectively, the ink-jet recording apparatus being provided with a driving signal generator for continuously generating multiple driving signals applied to the actuator, the driving signal generator producing:

an expansion pulse which expands a volume of the ink chamber by deforming the actuator contained in the dividing wall of the ink chamber;

a shrinkage pulse which compresses the volume of the ink chamber by deforming the actuator; and a predetermined quiescent period between the expansion pulse and the shrinkage pulse, the droplets of the ink being ejected on a recording media from the ink-nozzles by a repeated expansion and shrinking of the ink chamber, and the quiescent period being regulated so as to decrease the cross talk among the ink chambers adjacent to each other, (b) hardening the droplets of the ink ejected on the recording media via irradiation of an actinic ray, wherein a volume of each of the droplets of the ink is between 2 to 15 pl, and the ink contains a radical polymerization monomer and a radical initiator.

(2) A method for forming an ink-jet image, comprising the steps of:

(a) ejecting droplets of an ink through ink-nozzles of an ink-jet head of an ink-jet recording apparatus, the ink-jet head being provided with:

(i) a plurality of ink chambers having the ink-nozzles, each ink chamber having a dividing wall between adjacent ink chambers, the dividing wall containing an actuator which deforms in response to applied voltages to the adjacent ink chambers; and (ii) a common ink tank which communicates with the ink chambers respectively, the ink-jet recording apparatus being provided with a driving signal generator for continuously generating multiple driving signals applied to the actuator, the driving signal generator producing:

an expansion pulse which expands a volume of the ink chamber by deforming the actuator contained in the dividing wall of the ink chamber;

a shrinkage pulse which compresses the volume of the ink chamber by deforming the actuator; and a predetermined quiescent period between the expansion pulse and the shrinkage pulse, the droplets of the ink being ejected on a recording media from the ink-nozzles by a repeated expansion and shrinking of the ink chamber, and the quiescent period being regulated so as to decrease the cross talk among the ink chambers adjacent to each other, (b) hardening the droplets of the ink ejected on the recording media via irradiation of an actinic ray, wherein the ink contains a cationic polymerization monomer and an acid generating agent.

(3) The method for forming an ink-jet image of item 1 or item 2, wherein the predetermined quiescent period between the expansion pulse and the shrinkage pulse is set so that a time difference between a center of the expansion pulses and a center of the shrinkage pulses is equal to a natural vibration period of the ink in the ink chamber.

(4) The method for forming an ink-jet image of item 1 or item 2, wherein the predetermined quiescent time between the expansion pulse and the shrinkage pulse is controlled based on a change of the ink natural vibration period produced by a change of an ink temperature change, the ink temperature being detected with an ink temperature detector provided in the ink chamber.

(5) The method for forming an ink-jet image of item 2, wherein the cationic polymerizable monomer contained in the ink is an oxetane compound or an epoxy compound.

(6) The method for forming an ink-jet image of item 5, wherein the oxetane compound is a compound having an oxetane ring in which the 2-position is substituted.

(7) The method for forming an ink-jet image of item 5, wherein at least one of the epoxy compound is an epoxidized fatty acid ester or an epoxidized fatty acid glyceride.

(8) The method for forming an ink-jet image of item 1 or item 2, wherein the actinic ray is an ultraviolet ray.

(9) A printed matter produced with the method for forming an ink-jet image of item 1 or item 2, wherein a non ink absorptive recording material is employed on which the droplets of the ink are ejected.

(10) The ink-jet recording apparatus in the method for forming an ink-jet image of item 1 or item 2, wherein the ink and the ink-jet head are heated to 35 to 100° C. during ejection of the droplets of the ink.

DESCRIPTION OF THE PREFERRED EMBODIMENTS

Figure 1:
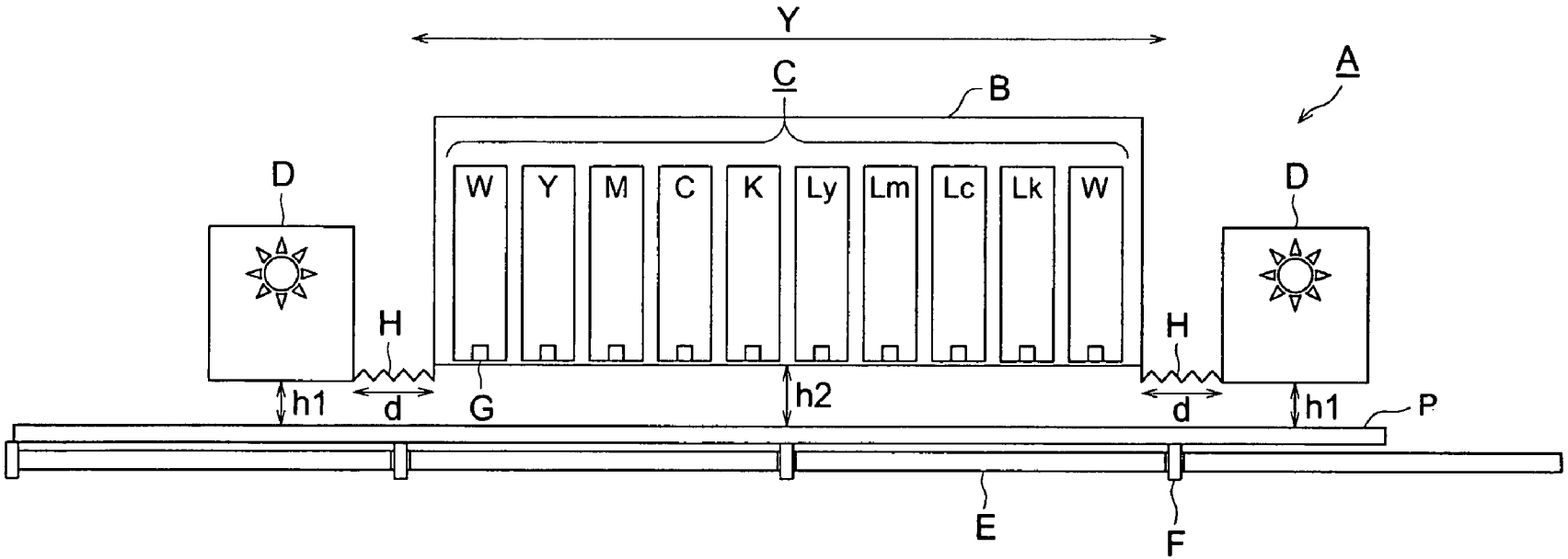
FIG. 1: A symbolic front view showing significant parts and their configuration of the image recording apparatus used in this invention.

The present invention will now be detailed below. Firstly, regarding an image forming recording apparatus employed in the image forming method of this invention, the details will be described with reference to drawings. Meanwhile, the image recording apparatus or the ink-jet recording head (hereinafter, referred to simply as a recording head) in the drawings is merely one embodiment employable in the recording method or the image recording apparatus of this invention, but this invention is not limited to the contents described in these drawings.

FIG. 1 is a front view showing significant parts and their configuration of the image recording apparatus of this invention. Image Recording Apparatus A comprises Head Carriage B, Recording Head C, Radiation Means D, and Platen E. Platen E is placed under Recording Material P in this Image Recording Apparatus A. Platen E has a function to absorb ultraviolet rays, and the excessive UV rays passed through Recording Material P. As a result, high-definition images can be obtained with extreme stability.

Recording Material P is guided by Guide Member F, and is transported from the front to the back of FIG. 1, according to the function of transportation means (not illustrated in the drawings) Head scanning means (also not illustrated in the drawings) scans Recording Head C incorporated in Head Carriage B, which moves reciprocally in the Y direction of FIG. 1.

Head Carriage B is placed on the upper side of Recording Material P, and houses a plurality of Recording Heads C, mentioned later, based on color used for image printing onto Recording Material P, allocating the ink ejection orifices on the down stream side. Head Carriage B is placed in the main body of Image Recording Apparatus A, in the universal reciprocating form in the Y direction in FIG. 1, and based on driving of the head scanning means, moves reciprocally in the Y direction in FIG. 1.

Illustrated in FIG. 1 is Head Carriage B which houses Recording Heads C of white (W), yellow (Y), magenta (M), cyan (C) and black (B), however, the number of color Recording Heads C housed in Head Carriage B in practice is determined as suitable.

Details of the recording head will be described later, but this Recording Head C ejects activating ray curable ink (for example, UV curable ink) supplied by means of an ink supplying means (not illustrated) from ejection orifices toward Recording Material P by plural ejecting means being mounted inside. A UV curable ink ejected by Recording Head C is composed of a coloring material, a polymerizing monomer and an initiator, and exhibits a property of curing by a cross-linking and polymerization reaction in conjunction with an initiator action as a catalyst caused by UV irradiation.

Recording Head C ejects UV curable ink (hereinafter, referred to simply as ink) as ink droplets on a certain region (being an intended region of ink droplet deposition) of Recording Material P during scanning in which the head moves from one edge to the other edge of Recording Material P in the Y direction in FIG. 1 driven by the head scanning means, and deposits ink droplets in the intended region for ink droplet deposition.

After the above described scanning is suitably performed several times, ink is ejected onto one part of the possible regions of ink droplet deposition, ink is ejected onto the next intended region of ink droplet deposition, adjacent to and behind the above described possible region of ink droplet deposition, by Recording Head C, while Recording Material P is optimally transported from the front to the rear direction in FIG. 1.

By repeating the above operation to eject ink from Recording Head C in accordance with the head scanning means and the transport means, images comprising varying sized ink droplets are formed on Recording Material P.

After ink is deposited onto Recording Material P, light irradiation is conducted with Radiation Means D. Light irradiation may be visible light or UV irradiation, and specifically UV irradiation is preferable. In cases when UV irradiation is conducted, the UV irradiation amount is not less than 100 mJ/m$^2$, and preferably not less than 500 mJ/m$^2$, and is further not more than 10,000 mJ/m$^2$, and preferably not more than 5,000 mJ/m$^2$. The UV irradiation amount in such a range, is an advantageous effect to sufficiently complete curing reaction, and to also prevent fading of coloring agents by UV irradiation.

UV irradiation may be conducted using means such as a metal halide lamp, a xenon lamp, a carbon arc lamp, a chemical lamp, a low pressure mercury lamp, a high pressure mercury lamp, an excimer laser, a UV laser, a cold cathode tube, a black light, and an LED (light emitting diode), and a metal halide lamp tube having a belt-shape, a cold cathode tube, a mercury lamp tube and a black light are preferable. Specifically a cold cathode tube and a black light which emit ultraviolet rays at a wavelength of 365 nm are preferable, which results in bleeding prevention, efficient control of dot diameter as well as a decrease of wrinkles during curing. By utilizing a black light as a radiation source of Radiation means 4, Radiation Means D for UV ink curing can be prepared inexpensively. Specifically, a metal halide lamp exhibits high emission efficiency in the range of 200–450 nm as well as being abundant in a long wavelength region, due to a continuous spectrum, compared to a high pressure mercury lamp (at a main wavelength of 365 nm). Therefore, regarding the activating ray curable ink of this invention, in cases when pigment ink is employed, a metal halide lamp is suitable.

Radiation Means D has a shape nearly equal to the maximum region which can be set by Recording Apparatus A (being a UV ink-jet printer) or larger than the possible region of ink droplet deposition, among the several intended regions of ink droplet deposition where UV ink is ejected by Recording Head C in a single scanning driven by a head scan means.

Radiation Means D is arranged to fix on both sides of Head Carriage B nearly parallel to Recording Material P.

As described above, in a means to adjust illuminance at the ink ejecting section, it is natural to light-shield the whole Recording Head C, however, in addition, it is effective to make distance h2 between ink ejection outlet G of Recording Head C and Recording Material P longer than distance h1 between Radiation Means D and Recording Material P (h1<h2), and to make distance d between Recording Head C and Radiation Means D longer (to make d large). Further, it is further preferable to provide Bellows Structure H between Recording Head C and Radiation Means D.

Herein, the wavelength of ultraviolet rays irradiated at Radiation Means D can be suitably changed by changing the UV lamp or the filter which are provided in Radiation Means D.

Secondly, the ink-jet Recording Head and a driving method to prevent cross talk of this invention will be detailed.

As an ink-jet recording head, well known is an on-demand method ink-jet recording head in which dividing walls of adjacent ink chambers comprise actuators, such as piezo-electric members. This type of head has the advantage that many ink chambers divided by dividing walls can be easily arranged in a very dense state.

Figure 2:
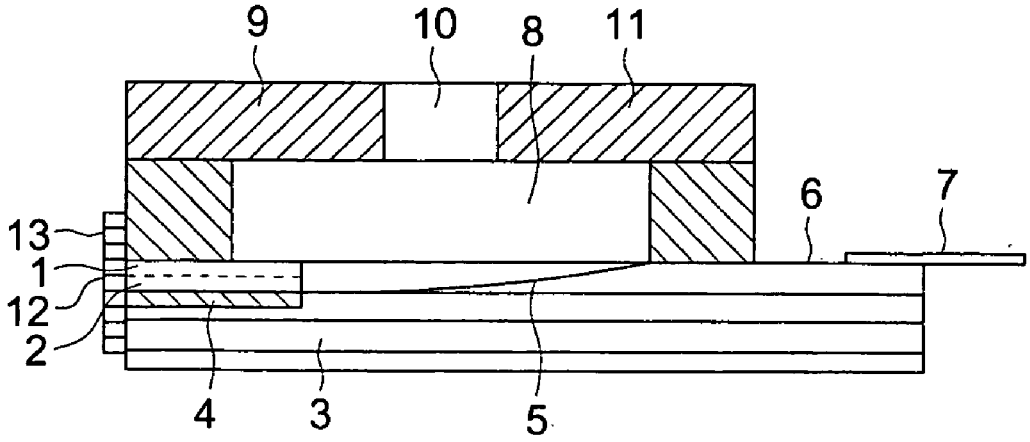
FIG. 2: A longitudinal sectional view showing the configuration of the ink-jet head used in this invention.

For example, an ink-jet recording head using piezo-electric members as an actuator is structured to form Ink chamber 4 as shown in FIGS. 1 and 2 by the steps of:

(1) gluing two pieces of rectangular Piezo-electric Members 1 and 2 together, being opposite in polarization and facing to the outside in the plate thickness direction;

(2) fixing them onto Base Plate 3 having a lower dielectric constant than the piezo-electric members; and (3) grooving these Piezo-electric Members 1 and 2 to produce a plurality of long flutes at regular intervals, parallel and the same width and depth, and in the same length, using means such as a diamond cutter.

Electrode 5 is formed on the side face and the bottom surface of Ink chamber 4 with electroless nickel plating, and further, Electrode 6 is similarly formed from the back-end of Ink chamber 4 to the top surface of the back part of foregoing Base Plate 3, also with electroless nickel plating. Further, Circuit Board 7 forming a driving circuit is fixed onto the back-end top surface of Base Plate 3.

Onto the top surface of Ink chamber 4 using foregoing Piezo-electric Members 1 and 2, Frame Shaped Member 9 comprising Common Ink tank 8 is fixed, and further, the top surface of Frame Shaped Member 9 is blocked by using Top Plate 11 provided Ink Supply Outlet 10 connected with Common Ink tank 8. Further, at the very top of each Piezo-electric Members 1 and 2, Orifice Plate 13 provided a plurality of Ink Ejecting Orifices 12 is fixed using an adhesive agent.

Next, principles of operation of this ink-jet recording head will be described.

Figure 4:
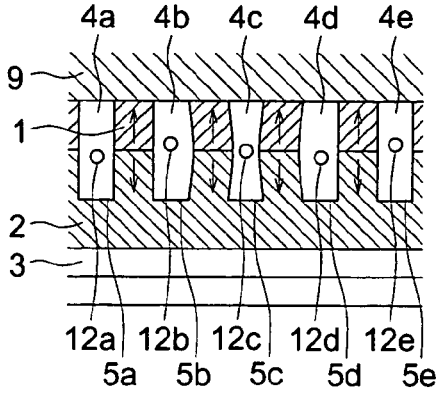
FIG. 4: A cross-sectional view showing principle of operation of the ink-jet head used in this invention.
Figure 4:
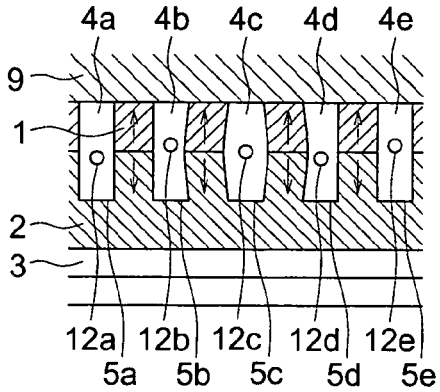

In FIG. 4(*a*) and FIG. 4(*b*), focusing on five ink chambers 4*a*, 4*b*, 4*c*, 4*d* and 4*e*, in cases when a positive voltage is applied to Electrode 5*c* of central Ink chamber 4*c*, when Electrodes 5*a*–5*e* of Ink chambers 4*a*–4*e* respectively are in the state of ground potential, both side surfaces of Ink chamber 4*c* are transformed on the inside to contract the volume of Ink chamber 4*c* with a shear strain due to the polarization directions of Piezo-electric Members 1 and 2 which face away from each other as shown by arrows in the figure.

Further, when Electrodes 5*a*–5*e* of Ink chambers 4*a*–4*e* respectively are grounded, in cases when a positive voltage is applied to Electrodes 5*a*, 5*b*, 5*d* and 5*e* of Ink chambers 4*a*, 4*b*, 4*d* and 4*e* respectively adjacent to central Ink chamber 4*c*, both side surfaces of Ink chamber 4*c* are transformed adversely on the outside to expand the volume of Ink chamber 4*c*. Utilizing these deformations of the ink chamber, ink droplets are ejected from the ink chamber. Exemplarily, after the ink chamber is filled with ink from Common ink tank 8 by expanding volume of the ink chamber, inside pressure of the ink chamber is increased by reducing the volume of the ink chamber, resulting in ejection of ink droplets from Ink Ejecting Orifice 12.

Next, the driving method of the ink-jet recording head of this invention will be described.

Figure 5:
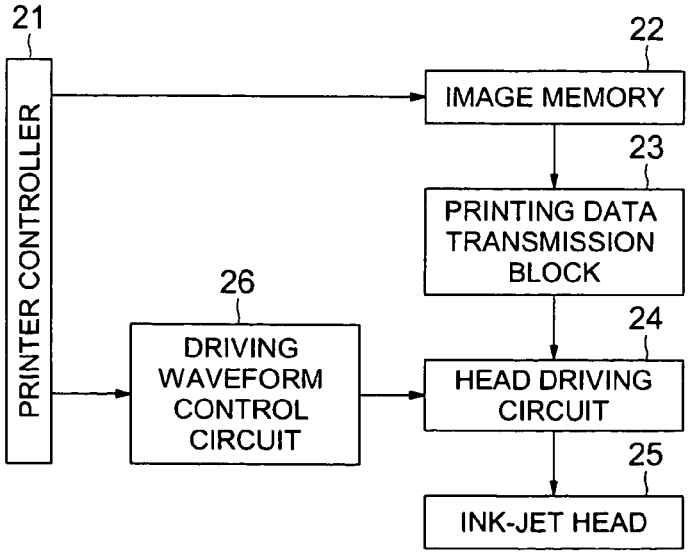
FIG. 5: A block diagram showing the configuration of the ink-jet head driving apparatus used in this invention.

FIG. 5 is a block diagram showing the configuration of the ink-jet recording head in these embodiments. In FIG. 5, 21 is a printer controller controlling each section, 22 is an image memory, used for storing data for printing sent from Printer Controller 21, and 23 is a printing data transmission block which is controlled by Printer Controller 21 and transfers the printing data stored in Image Memory 22 to Head Driving Circuit 24.

Head Driving Circuit 24 is designed to drive Ink-jet Recording Head 25 based on the printing data transferred from Printing Data Transmission Block 23. Driving waveform during the time that Head Driving Circuit 24 drives Ink-jet Recording Head 25, is regulated by Driving Waveform Control Circuit 26, and this Driving Waveform Control Circuit 26 is regulated with foregoing Printer Controller 21.

Figure 3:
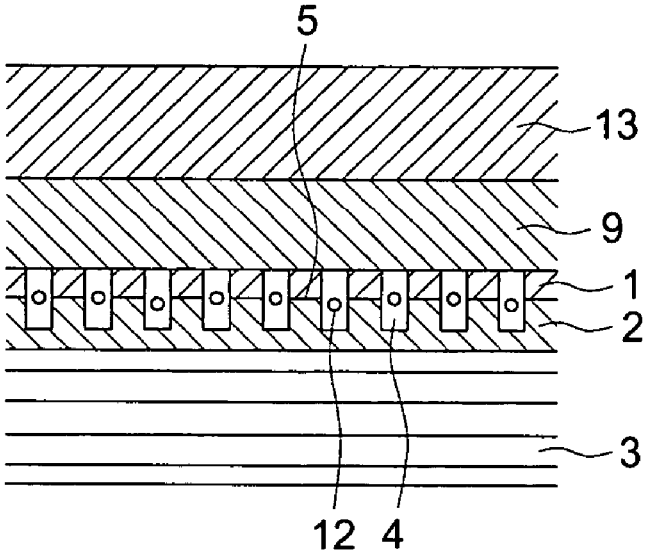
FIG. 3: A cross-sectional view showing the ink-jet head portion used in this invention.

Ink-jet Recording Head 25 used in this invention is a share-mode type ink-jet recording head, and its configuration is the same as the ink-jet recording head those shown in FIGS. 2 and 3.

Figure 6:
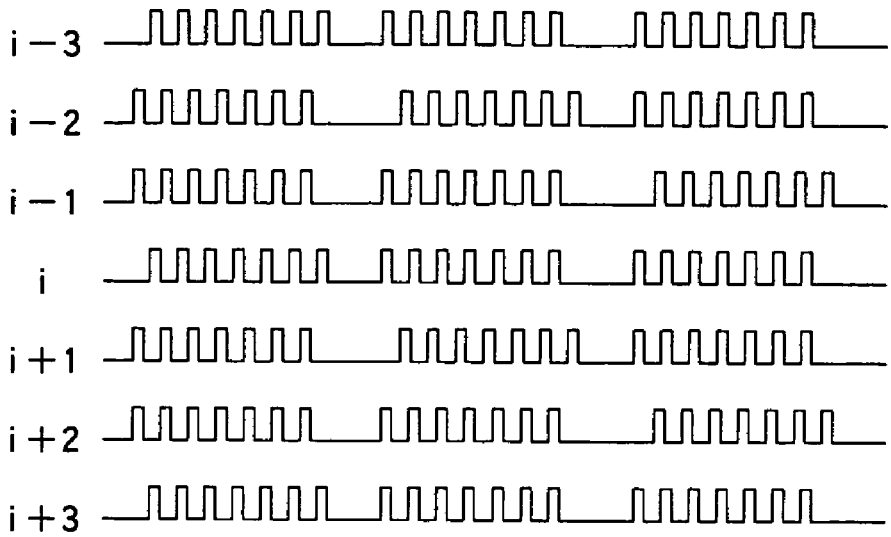
FIG. 6: A figure showing the head driving waveforms of this invention.
Figure 7:
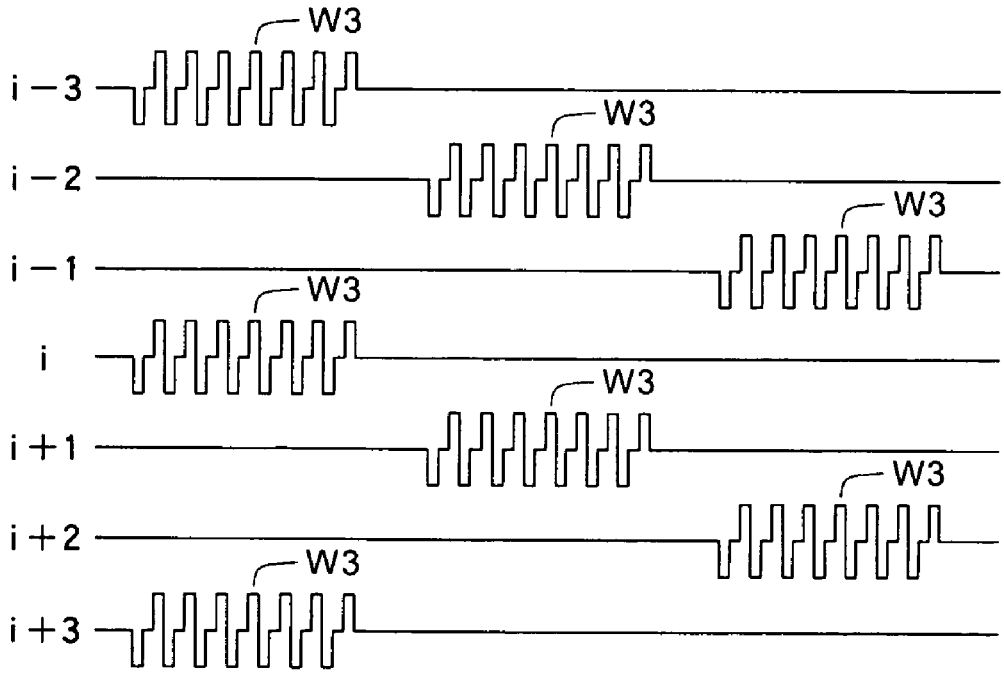
FIG. 7: A figure showing another example of the head driving waveforms of this invention.
Figure 8:
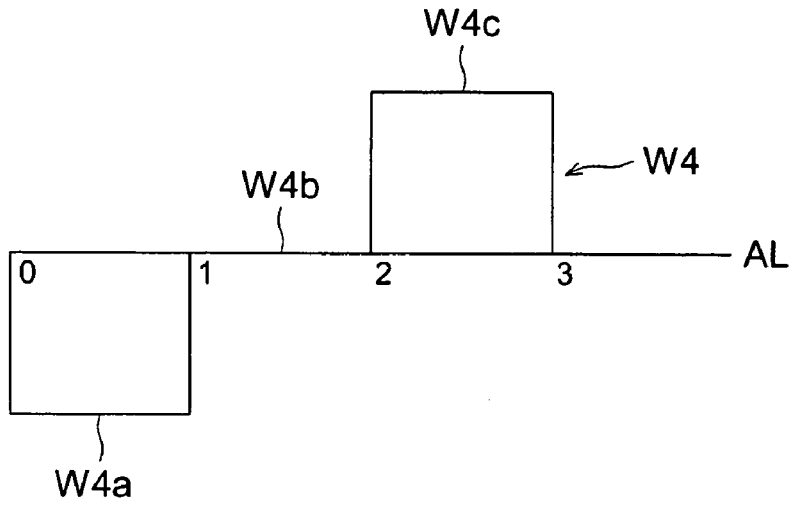
FIG. 8: A figure showing detailed configuration of the driving pulse of the driving waveform in FIG. 7.

FIGS. 6–8 show driving waveforms when Head Driving Circuit 24 activates the ink chambers of Ink-jet Recording Head 25. In addition, in these figures, i−3, i−2, i−1, i, i+1, i+2 and i+3 indicate continuously seriate ink chambers.

FIG. 6 shows the driving waveforms of 7 drop driving when positive potential is applied to each of Ink chambers i−3–i+3 at specific timing. FIG. 7 shows the driving waveforms by which each of Ink chambers i−3–i+3 is driven for 7 drops, setting applied voltage of non-operating ink chambers to ground potential.

Utilizing the driving waveforms of FIG. 6 and the ones in FIG. 7, the ink chambers move identically, however, described here is the case of driving the ink chambers using the driving waveforms of FIG. 7.

In this share-mode type recording head, tripartition driving is conducted, such as 1) Ink chambers i−3, i and i+3 are simultaneously driven, but Ink chambers i±2 and i±1 placed between the above tanks are not driven at that time; 2) Ink chambers i−2 and i+1 are simultaneously driven, but Ink chambers i and i−1 placed between them are not driven at the time; and 3) Ink chambers i−1 and i+2 are simultaneously driven, but Ink chambers i and i+1 are not driven at that time. With this tripartition driving, ink chambers adjacent to the driving ink chamber are aimed not to be affected directly to cause erroneous ink ejection.

Each of Driving Waveforms W3 shown in FIG. 7 is the waveform of seven continued Driving Pulses W4, the configuration of which is shown in FIG. 8. Each of Driving Pulses W4 is formed by Expansion Pulse W4*a* of a negative voltage pulse to adequately expand the ink chamber; Quiescent Time W4*b* terminates the pulse application; and Shrinkage Pulse W4*c* of a positive voltage pulse adequately compresses the ink chamber.

This ink-jet recording head performs a single drop ejection of one microscopic ink droplet when Driving Pulse W4 is applied one. Since Driving Pulses W4 continue in the range of 1–7, 1–7 drop driving is selectively conducted, resulting in the possibility of 7 tone printing, except white.

Time difference between the center of Expansion Pulse W4*a* and the center of Shrinkage Pulse W4*c* is 2 AL, and set to equal the natural vibration period of ink in the ink chamber. A pulse period width of Expansion Pulse W4*a* is set to 1 AL, and a pulse period width of Shrinkage Pulse W4*c* is set to be in the range of 0.6–1 AL, but here is set to 1 AL. Further, AL is a unit of period in which pressure in the ink chamber changes from positive pressure to negative pressure due to specific vibration, or reversing from negative pressure to positive pressure, and consequently, it becomes a half period of the specific vibration period of ink in the ink chamber.

Figure 9:
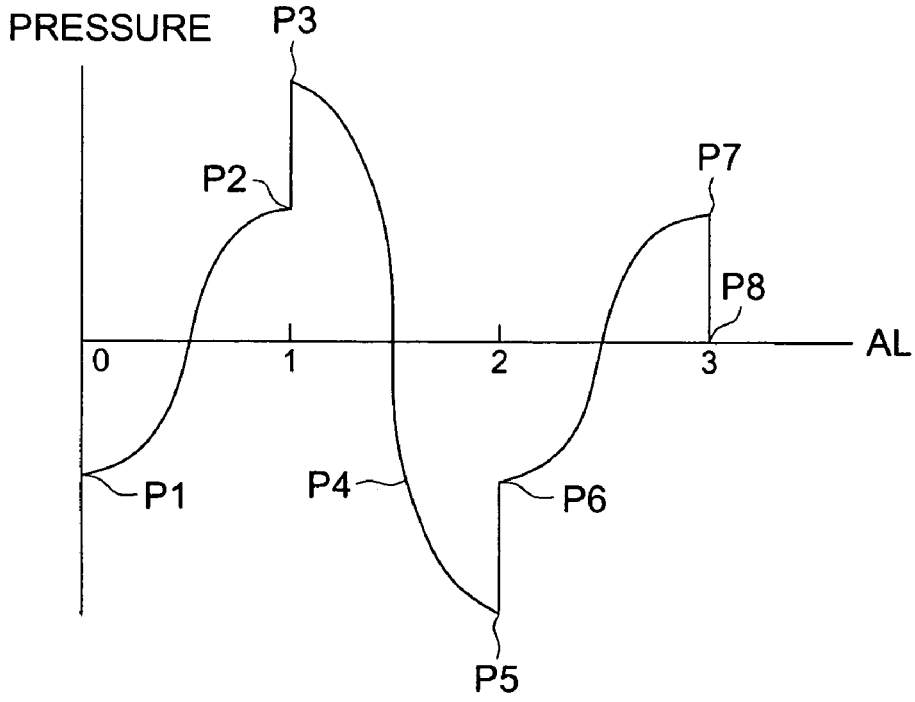
FIG. 9: A detail of the waveform figure showing the pressure changes of the ink chamber when the driving pulse of FIG. 8 is applied to the ink chamber.

Next, pressure changes in the ink chamber of Ink-jet Recording Head 25, when the driving pulse is applied as shown in FIG. 8, will be described referring to FIG. 9. Firstly, Expansion Pulse W4*a* expands the volume of the ink chamber in the rising portion of its waveform, leading to the pressure of ink inside the tank being Negative Pressure P1. And, when the period of 1 AL continues from the rising edge of the waveform, ink pressure in the ink chamber becomes Positive Pressure P2 with the specific vibration. Further, when Expansion Pulse W4*a* is terminated, the ink chamber shrinks to further increase the ink pressure from P2–P3, resulting in initiation of ink ejection from the ink ejecting orifice of the ink chamber.

After approximately 0.5 AL from start of the ink ejection, ink pressure in the ink chamber changes to Negative Pressure P4 due to the specific vibration. Then, at the point of 1 AL passing from the rising edge of Expansion Pulse W4*a*, ink ejection ceases. At this point, Quiescent Time W4*b* ends, and the ink chamber is compressed by the rising edge of Shrinkage Pulse W4*c*, after which the negative pressure of the ink chamber is reduced from P5–P6.

As point of 1 AL passing the rising portion of Shrinkage Pulse W4*c*, ink pressure becomes Positive Pressure P7. At this point, Shrinkage Pulse W4*c* begins to fall, resulting in almost zero pressure in the ink chamber due to the ink chamber returning from shrinking to the original state. Thus, by providing the driving pulse shown in FIG. 4 to the ink chamber of the ink-jet recording head, remaining pressure vibration having the specific vibration frequencies which tend to cause cross talk, can possibly be reduced to almost zero.

Figure 10:
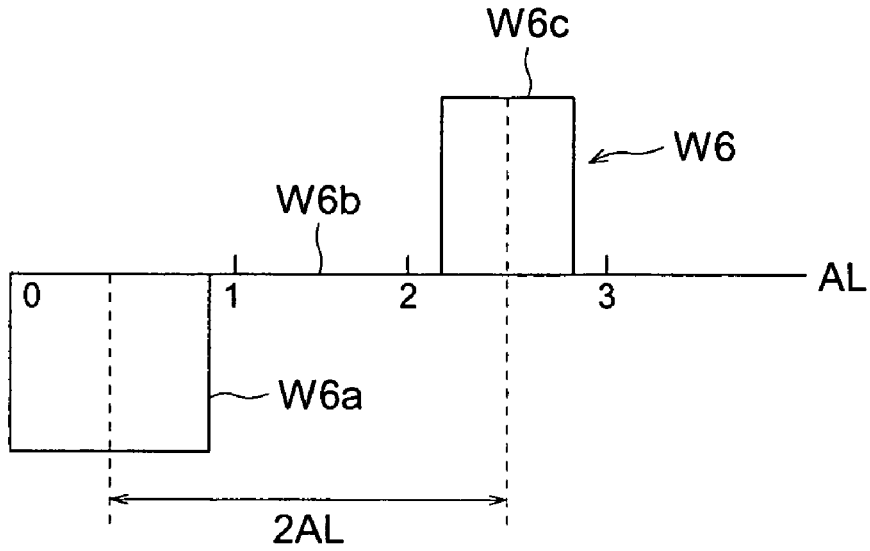
FIG. 10: A figure showing another example of the driving pulse of this invention.

Further, as a driving pulse, Driving Pulse W6 may be employed as shown in FIG. 10. This Driving Pulse W6 narrows the period width of Shrinkage Pulse W6*c* maintaining the time difference between the center of Expansion Pulse W6*a* and the center of Shrinkage Pulse W6*c* at 2 AL. As a result, Quiescent Time W6*b* becomes longer by that time difference.

Such Driving Pulse W6 is effective to a specific head, for example, pressure vibration caused by Expansion Pulse W6*s* is attenuated during application of Shrinkage Pulse W6*c*. With this kind of head, effects of effectively attenuating the remaining pressure vibration are obtainable.

Details of activating ray curable ink of this invention will now be described.

In this invention, one of the characteristics is that activating curable ink contains a radical polymerizing monomer and a radical initiator.

Radical polymerizable compounds usable in this invention are compounds having an ethylenic unsaturated bond enabling radical polymerization, and many kinds of compounds can be used as long as they have at least one ethylenic unsaturated bond enabling radical polymerization, containing one having chemical conformation such as a monomer, an oligomer and a polymer. A radical polymerizable compound can be used alone or in combination of more than two kinds in optional ratios to enhance the objective characteristics.

Examples of compounds having a radical polymerizable ethylenic unsaturated bond include unsaturated carboxylic acids such as acrylic acid, methacrylic acid, itaconic acid, crotonic acid, isocrotonic acid and maleic acid, and their salts, esters, urethanes and anhydrides, acrylonitrils, styrenes; and further radical polymerizable compounds such as various unsaturated polyesters, unsaturated polyethers, unsaturated polyamides, and unsaturated urethanes. In particular, acrylic acid derivatives such as 2-thylhexyl acrylate, 2-hydroxyethyl acrylate, butoxyethyl acrylate, carbitol acrylate, cyclohexyl acrylate, tetrahydrofurfuryl acrylate, benzyl acrylate, bis(4-acryloxypolyethoxyphenyl)propane, neopentyl glycol diacrylate, 1,6-hexanediol diacrylate, ethylene glycol diacrylate, diethylene glycol diacrylate, triethylene glycol diacrylate, tetraethylene glycol diacrylate, polyethylene glycol diacrylate, polypropylene glycol diacrylate, pentaerythritol triacrylate, pentaerythritol tetraacrylate, dipentaerythritol tetraacrylate, trimethylolpropane triacrylate, tetramethylolmethane tetraacrylate, oligoester acrylate, N—, ethylol acrylamide, diacetone acrylamide, and epoxy acrylate; methacryl derivatives such as methyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacrylate, triethylene glycol dimathacrylate, polyethylene glycol dimethacrylate, polypropylene glycol dimethacrylate, trimethylolethane trimethacrylate, trimethylolpropane trimethacrylate, 2,2-bis( 4-methacryloxypolyethoxyphenyl) propane; in addition, allyl compound derivatives such as allylglycidyl ether, diallyl phthalate, and triallyl trimellitate, and further concretely, usable can be radical polymerizable or cross linking monomers, oligomers and polymers which are products on the market or well known in the industry, and also described in "Cross-linking Agent Handbook", edited by Shinzo Yamashita, published by Taisei-sha, 1981; "UV•EB Cure Handbook", edited by Seishi Kato, under the editorship of The Society of Polymer Science, Japan, 1985; "Application of UV•EB Curing Technology and its Market" pg. 79, edited by Rad Tech Japan, published by CMC Publishing Co. Ltd., 1989; "Polyester Resin Handbook" by Eiichiro Takiyama, published by THE NIKKAN KOGYO SHIMBUN, LTD., 1988. The amount of the foregoing radical polimerizable compounds is preferably 1–97 weight %, and more preferably 30–95 weight %.

As radical polymerizing initiators, listed are triazine derivatives described in examined Japanese Patent Publication (hereinafter, referred to as JP-B) Nos. 59-1281 and 61-9621, and also unexamined Japanese Patent Publication (hereinafter, referred to as JP-A) 60-60104; organic peroxides described in JP-A Nos. 59-1504 and 61-243807; diazonium compounds described in JP-B Nos. 43-23684, 44-6413, 44-6413 and 47- 1604, and U.S. Pat. No. 3,567, 453; organic azide compounds described in U.S. Pat. Nos. 2,848,328, 2,852,379 and 2,940,853; ortho-quinonediazides described in JP-B Nos. 36-22062, 37-13109 and 45-9610; various onium compounds described in JP-B 55-39162, JP-A 59-14023, and "Macromolecules", vol. 10, pg. U.S. Pat. No. 1,307, 1977; azo compounds described in JP-A 59-142205; metal allene complexes described in JP-A 1-54440, European Patent Nos. 109,851 and 126,712, "J. Imag. Sci." (Journal of Imaging Science), vol. 30, pg.174, 1986; (oxo) sulfonium organic boron complexes described in JP-A Nos. 5-213861 and 5-255327; titanocenes described in JP-A 61-151197; transition metal complexes containing transition metals such as ruthenium described in "Coordination Chemical Review", vol. 84, pgs. 85–277, 1988; 2,4,5-triarylimidazole dimer and carbon tetrabromide described in JP-A 2-182701; and organic halogen compounds described in JP-A 59-107344. These polymerization initiators are preferably contained in the range of 0.1–10 weight parts per 100 weight parts of an ethylenic unsaturated bond containing compound enabling radical polymerization.

In this invention, it is one of the characteristics that active ray curable ink contains a cationic polymerizable monomer and an acid generating agent.

In this invention, it is also one of the characteristics that a volume of each of the droplets of the ink is between 2 to 15 pl (picoliter).

As a cationic polymerizable monomer in this invention, an oxetane compound or an epoxy compound is preferable.

An oxetane compound of the present invention will be described.

In the present invention, an oxetane compound has preferably an oxetane ring represented by General Formula (1) in the molecule.

<<A Compound having a Substituent at the 2-Position of the Oxetane Ring in the Molecule>>

General Formula (1)

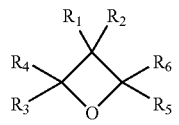

werein, $R_1$–$R_6$ each represents a hydrogen atom or a substituent, however, at least one of the groups represented by R3–R6 is a substituent.

In General Formula (1), $R_1$–$R_6$ each represents a hydrogen atom, a fluorine atom or an alkyl group having 1–6 carbon atoms (e.g., a methyl group, an ethyl group, a propyl group or a butyl group), an fluorinated alkyl group having 1–6 carbon atoms, an ally group, an aryl group (e.g., a phenyl group, a naphtyl group, a furyl group or a thienyl group. These may further have a substituent.

<An compound having an Oxetane Ring in the Molecule>

Among compounds represented by General Formula (1), a more preferable compound is represented by General Formulas (2)–(5) described below.

General Formula (2)

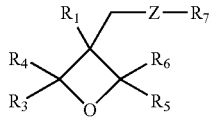

General Formula (3)

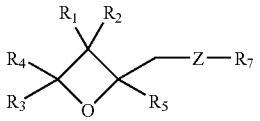

General Formula (4)

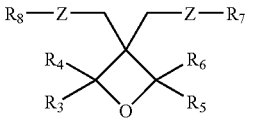

General Formula (5)

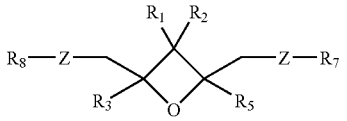

In General Formula (2) to (5), $R_1$–$R_6$ each represents a hydrogen atom or a substituent, $R_7$ and $R_8$ each represents a substituent, Z represent independently an oxygen atom or a sulfur atom, or a divalent hydrocarbon group which may have an oxygen atom or a sulfur atom in the main chain.

In General Formula (2) to (5), the substituents represented by $R_1$–$R_6$ designate the same substituent as by $R_1$–$R_6$ in General Formula (1).

$R_7$ and $R_8$ in General Formula (2) to (5) each represents an alkyl group having 1–6 carbon atoms (e.g., a methyl group, an ethyl group, a propyl group or a butyl group), an alkenyl group having 1–6 carbon atoms (e.g., a 1-propenyl group, a 2-propenyl group, a 2-methyl-1-propenyl group, a 2-methyl-2-propenyl group, a 1-butenyl group, a 2-butenyl group, or a 3-butenyl group), an aryl group (e.g., a phenyl group, a benzyl group, a fluorobenzyl group, a methoxybenzyl group or a phenoxybenzyl group), an alkylcarbonyl group having 1–6 carbon atoms (e.g., a propylcarbonyl group, a butylcarbonyl group, or a pentylcarbonyl group), an alkoxycarbonyl group having 1–6 carbon atoms (e.g., an ethoxycarbonyl group, a propoxycarbonyl group, or a butoxycarbonyl group), an alkylcarbamoyl group having 1–6 carbon atoms (e.g.,a propylcarbamoyl group or a butylpentylcarbamoyl group, or an alkoxy carbamoyl group having 1–6 carbon atoms (e.g., an ethoxycarbamoyl group).

Listed examples of Z in General Formulas (2) to (5) are, an alkylene group (e.g. ethylene group, trimethylene group, tetramethylene group, propylene group, ethylethyelene group, pentamethyelene group, hexamethyelene group, heptamethylene group, octamethylene group, nanomethyelene group, decamethyelen group); an alkenylene group (e.g. vinylene group, propenylene group); and an alkynylene group (e.g. ethynylene group, 3-pentynylene group). The carbon atom in the aforementioned alkylene group, alkenylene group and alkynylene group may be replaced with an oxygen atom or a sulfur atom.

Among the substituents mentioned above, a preferable group for $R_1$ is a lower alkyl group (e.g. methyl group, ethyl group, and propyl group), a more preferable group is an ethyl group.

Preferably groups for $R_7$ and $R_8$ are, propyl group, butyl group, phenyl group or benzyl group.

Z is preferably a hydrocarbon group without containing an oxygen atom or a sulfur atom (e.g. alkylene group, alkenylene group or alkynylene group).

<An Oxetane Compound having at Least Two Oxetane Groups in the Molecule>

In the present invention, a compound represented by General Formulas (6) and (7) described below can be used.

General Formula (6)

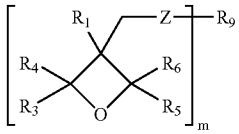

General Formula (7)

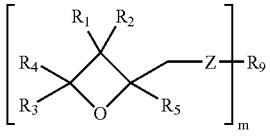

In General Formulas (6) and (7), Z designates the same as Z in Formulas (2) to (5); and m represents 2, 3, or 4.

$R_1$–$R_6$ each represents a hydrogen atom, a fluorine atom or an alkyl group having 1–6 carbon atoms (e.g., a methyl group, an ethyl group, a propyl group or a butyl group), an fluorinated alkyl group having 1–6 carbon atoms, an ally group, an aryl group, a furyl group. In General Formulas (6), at least one of $R_3$–$R_6$ is a substituent.

$R_9$ represents a straight or branched alkylene group having 1–12 carbon atoms, or a divalent group represented by General Formulas (9), (10) or (11).

Examples of branched alkylene groups having 1–12 carbon atoms are represented by General Formula (8) described below.

General Formula (8)

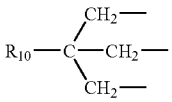

wherein $R_{10}$ represents a lower alkyl group (e.g., a methyl group, an ethyl group, or a propyl group).

General Formula (9)

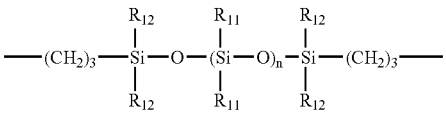

In General Formula (9), n represents 0 or an integer of 1–2,000, $R_{11}$ represents an alkyl group having 1–10 carbon atoms or the group represented by General Formula (12) described below.

$R_{12}$ represents an alkyl group having 1–10 carbon atoms (e.g., a methyl group, an ethyl group, a propyl group, a butyl group.

General Formula (12)

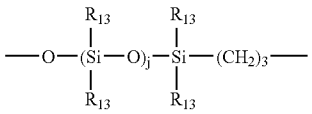

In General Formula (12), j represents 0 or an integer of 1–100, and $R_{13}$ represents an alkyl group having 1–10 carbon atoms (e.g., a methyl group, an ethyl group, a propyl group, a butyl group, a pentyl group, a hexyl group, a heptyl group, an octyl group, or a nonyl group).

General Formula (10)

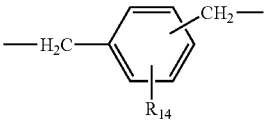

In General Formula (10), $R_{14}$ represents a hydrogen atom,an alkyl group having 1–10 carbon atoms (e.g., a methyl group, an ethyl group, a propyl group, a butyl group), an alkoxy group having 1–10 carbon atoms (e.g. a methoxy group, an ethoxy group, a propoxy group, a butoxy group, and a pentoxy group), a halogen atom (e.g., a fluorine atom, a chlorine atom, a bromine atom, or an iodine atom), a nitro group, a cyano group, a mercapto group, an alkoxycarbonyl group of lower alkyl number (e.g., a methyloxycarbonyl group, an ethyloxycarbonyl group, or a butyloxycarbonyl group), or a carboxyl group.

General Formula (11)

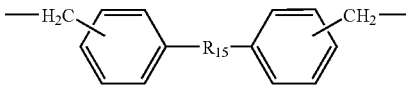

In General Formula (11), $R_{15}$ represents an oxygen atom, a sulfur atom, —NH—, —SO—, —$SO_2$—, —$CH_2$—, —$C(CH_3)_2$—, or —$C(CF_3)_2$—.

Embodiments of the preferred partial structure of compounds having an oxetane ring employed in the present invention are as follows. For example, in aforesaid General Formulas (6) and (7), $R_1$ is preferably a lower alkyl group (e.g., a methyl group, an ethyl group, or a propyl group), and is more preferably an ethyl group. Further, preferably employed as $R_9$ is a hexamethylene group or a group in which $R_{14}$ is a hydrogen atom in aforesaid General Formula (10).

In aforesaid General Formula (8), it is preferable that Rio is an ethyl group, $R_{12}$ and $R_{13}$ each is a methyl group, and Z is a hydrocarbon group which contains neither an oxygen atom nor a sulfur atom.

Further, listed as one example of preferred embodiments of compounds having an oxetane ring according to the present invention is the compound represented by General Formula (13) described below.

General Formula (13)

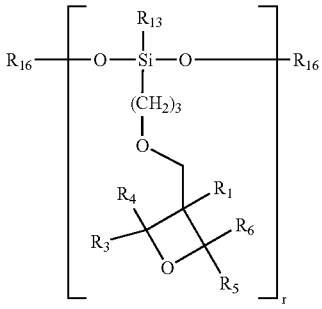

wherein r represents an integer of 25–200; $R_{16}$ represents an alkyl group having 1–4 carbon atoms (e.g., a methyl group, an ethyl group, a propyl group, or a butyl group), or a trialkylsilyl group; $R_1$, $R_3$, $R_5$, and $R_6$ each is the same as a substituent represented by each of $R_1$–$R_6$ in aforesaid General Formula (1), however, at least one of $R_3$–$R_6$ is a substituent.

Specific examples of compounds having an oxetane ring, in which position 2 is substituted, are shown as Exemplified Compounds 1–13. However, the present invention is not limited thereto.

1: trans-3-tert-butyl-2-phenyloxetane
2: 3,3,4,4-tetramethyl-2,2-diphenyloxetane
3: di[3-ethyl(2-methoxy-3-oxetanyl)]methyl ether
4: 1,4-bis(2,3,4,4-tetramethyl-3-ethyl-oxetanyl)butane
5: 1,4-bis(3-methyl-3-ethyl-oxetanyl)butane
6: di(3,4,4-trimethyl-3-ethyloxetanyl)methyl ether
7: 3-(2-ethyl-hexyloxymethyl)-2,2,3,4-tetramethyloxetane
8: 2-(2-ethyl-hexyloxy)-2,3,3,4,4-pentamethyl-oxetane
9: 4,4'-bis[(2,4-dimethyl-3-ethyl-3-oxetanyl)methoxy]biphenyl
10: 1,7-bis(2,3,3,4,4-pentamethyl-oxetanyl)heptane
11: oxetanyl silsesquioxatane
12: 2-methoxy-3,3-dimethyloxane
13: 2,2,3,3-tetramethyloxetane
14: 2-(4-methoxyphenyl)-3,3-dimethyloxetane
15: di[2-(4-methoxyphenyl)-3-methyloxetane-3-yl]ehter It is possible to synthesize the compounds according to the present invention, which have an oxetane ring in which at least position 2 is substituted, with reference to publications described below.

(1) Hu Xianming, Richard M. Kellogg, Synthesis, 533–538, May (1995)
(2) A. O. Fitton, J. Hill, D. Ejane, R. Miller, Synth., 12, 1140 (1987)
(3) Toshiro Imai and Shinya Nishida, Can. J. Chem. Vol. 59, 2503–2509 (1981)
(4) Nobujiro Shimizu, Shintaro Yamaoka, and Yuho Tsuno, Bull. Chem. Soc. Jpn., 56, 3853–3854 (1983)
(5) Walter Fisher and Cyril A. Grob, Helv. Chim. Acta., 61, 2336 (1987)
(6) Chem. Ber. 101, 1850 (1968)
(7) "Heterocyclic Compounds with Three- and Four-membered Rings", Part Two, Chapter IX, Interscience Publishers, John Wiley & Sons, New York (1964)
(8) Bull. Chem. Soc. Jpn., 61, 1653 (1988)
(9) Pure Appl. Chem., A29 (10), 915 (1992)
(10) Pure Appl. Chem., A30 (2 & amp;3), 189 (1993)

(11) Japanese Patent Application Open to Public Inspection No. 6-16804

(12) DE 10221858

(Content in Photocurable Ink)

The amount of compounds according to the present invention, which have an oxetane ring in which at least position 2 is substituted, in a photocurable ink is preferably 1–97 percent by weight, and is more preferably 30–95 percent by weight.

(Use of Oxetane Compounds in Combination with other Monomers)

Further, compounds according to the present invention, which have oxetane ring(s) in which at least position 2 is substituted, may be employed individually or in combinations with two types which have different structures. Further, the aforesaid compound may be employed in combination with photopolymerizable compounds such as photopolymerizable monomers or polymerizable monomers described below. When employed in combinations, it is preferable that a mixture is prepared so that the amount of compounds having oxetane ring(s) in the aforesaid mixture is adjusted to 10–98 percent by weight. Still further, it is preferable that the amount of other photopolymerizable compounds such as photopolymerizable monomers and polymerizable monomers is adjusted to 2–90 percent by weight.

<An Oxetane Compound Having a Substituent only at the 3-Position of the Oxetane Ring in the Molecule>

In the present invention, a known oxetane compound can be used in combination with an oxetane compound having a substituent at the 2-position. Preferable oxetane compound is an oxetane compound having a substituent only at the 3-position of the oxetane ring in the molecule.

Examples of an oxetane compound having a substituent only at the 3-position of the oxetane ring in the molecule are disclosed in JP-A Nos. 2001-220526 and 2001-310937.

An oxetane compound having a substituent only at the 3-position of the oxetane ring in the molecule is represented by General Formula (14).

General Formula (14)

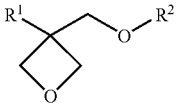

In the General Formula (14), $R^1$ is a hydrogen atom, alkyl group having 1–6 carbon atoms such methyl group, ethyl group, propyl group or butyl group, fluoro-alkyl group having 1 to 6 carbon atoms, allyl group, aryl group, furyl group, or thienyl group. $R^2$ is an alkyl group having 1 to 6 carbon atoms such as methyl group, ethyl group, propyl group or butyl group; alkenyl group having 2 to 6 carbon atoms such as 1-propenyl group, 2-propenyl group, 2-methyl-1-propenyl group, 2-methyl-2-propenyl group, 1-butenyl group, 2-butenyl group or 3-butenyl group; a group having aromatic ring such as phenyl group, benzyl group, fluoro-benzyl group, methoxy-benzyl group or phenoxy-ethyl group; alkyl carbonyl group having 2 to 6 carbon atoms such as ethyl carbonyl group, propyl carbonyl group or butyl carbonyl group; alkoxy carbonyl group having 2 to 6 carbon atoms such as ethoxy carbonyl group, propoxy carbonyl group or butoxy carbonyl group; N-alkyl carbamoyl group having 2 to 6 carbon atoms such as ethyl carbamoyl group, propyl carbamoyl group, butyl carbamoyl group or pentyl carbamoyl group. As the oxetane compound used in the present invention, it is particularly preferable that the compound having one oxetane ring is used, because the obtained composition is excellent in the coking property, and the operability is excellent in the low viscosity.

Next, as the compound having two oxetane rings, the compounds shown by the following General Formula (15) are listed.

General Formula (15)

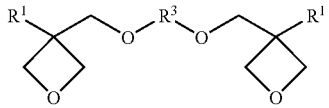

In the General Formula (15), $R^1$ is the same group as the group shown in the above-described General Formula (14). $R^3$ is, for example, a linear or branching alkylene group such as ethylene group, propylene group or butylene group; linear or branching poly (alkylene-oxy) group such as poly (ethylene oxy) group or poly (propylene oxy) group; linear or branching un-saturated hydrocarbon group such as propenylene group, methyl propenylene group or butenylene group; carbonyl group; alkylene group including carbonyl group; alkylene group including carboxyl group; alkylene group including carbamoyl group.

Further, $R^3$ may also be a polyhydric group selected from the group shown by the following General Formulas (16), (17) and (18).

General Formula (16)

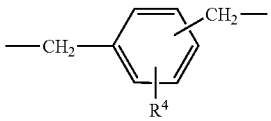

In the General Formula (16), $R^4$ is a hydrogen atom, an alkyl group having 1 to 4 carbon atoms such as methyl group, ethyl group, propyl group or butyl group, or alkoxy group having 1 to 4 carbon atoms such as methoxy group, ethoxy group, prop oxy group or butoxy group, or halogen atom such as chloride atom or bromine atom, nitro group, cyano group, mercapto group, lower alkyl carboxyl group such as the group having 1 to 5 carbon atoms, carboxyl group, or carbamoyl group.

General Formula (17)

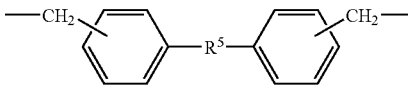

In the General Formula (17), $R^5$ is oxygen atom, sulfide atom, methylene group, —NH—, —SO—, —$SO_2$—, —$C(CF_3)_2$—, or —$C(CH_3)_2$—.

General Formula (18)

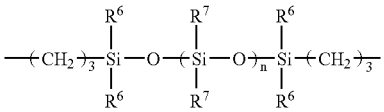

In the General Formula (18), $R^6$ is an alkyl group having 1 to 4 carbon atoms such as methyl group, ethyl group, propyl group or butyl group, or aryl group. Numeral n is an integer of 0–2000. $R^7$ is an alkyl group having 1 to 4 carbon atoms such as methyl group, ethyl group, propyl group or butyl group, or aryl group. $R^7$ is also a group selected from the group shown by the following General Formula (19).

General Formula (19)

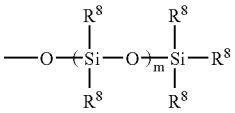

In the General Formula (19), $R^8$ is an alkyl group having 1 to 4 carbon atoms such as methyl group, ethyl group, propyl group or butyl group, or aryl group. Numeral m is an integer of 0–100.

As a specific example of the compound having 2 oxetane rings, the compounds shown by the following structural formulas are listed.

Exemplified compound 1

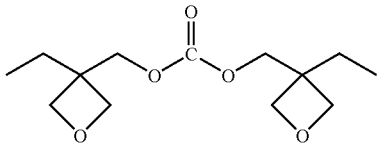

Exemplified compound 2

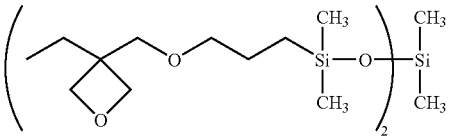

Exemplified compound 1 shown by the above structural formula is a compound in which $R^1$ is an ethyl group, and $R^3$ is a carboxy group in General Formula (15).

Exemplified compound 2 shown by the above structural formula is a compound in which each $R^6$ and $R^7$ are a methyl group, and n is 1 General Formula (18).

Among the compound having 2 oxetane rings, as a preferable example except for the above-described compounds, there are compounds shown by the following General Formula (20). In the General Formula (20), $R^1$ is the same group as in the General Formula (14).

General Formula (20)

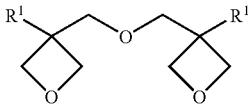

As the compounds having 3–4 oxetane rings, the compounds shown in the following General Formula (21) are listed.

General Formula (21)

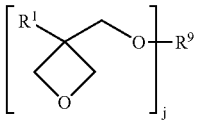

In the General Formula (21), $R^1$ is the same group as in the General formula (14). $R^9$ is, for example, a branching alkylene group having 1 to 12 carbon atoms such as groups shown by the following Formulas A–C, or a branching poly(alkylene oxy) group such as group shown by the following Formula D.

A

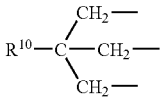

B

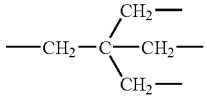

C

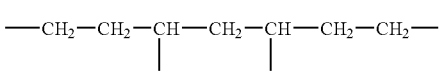

D

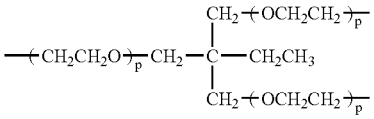

E

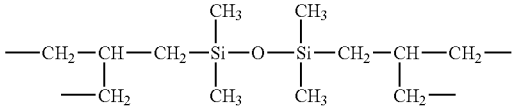

In Formula A, $R^{10}$ is a lower alkyl group such as a methyl, ethyl, or propyl group. In Formula D, p is an integer of 1 to 10.

As the specific example of the compound having 3 to 4 oxetane rings, the compound shown in the following Exemplified compound 3 is cited.

Exemplified compound 3

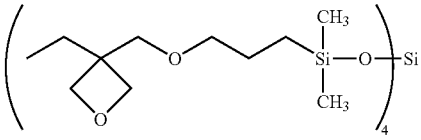

Furthermore, as an example of the compounds having 1–4 oxetane rings except the above examples, there are compounds shown in the following General Formula (22).

General Formula (22)

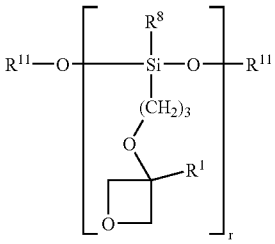

In the General Formula (22), $R^8$ is the same group as in the General Formula (19). $R^{11}$ is alkyl group having 1 to 4 carbon atoms such as methyl group, ethyl group, propyl group or butyl group, or tri-alkyl silyl group, and numeral r is 1–4.

As preferable specific examples of the oxetane compounds used in the present invention, there are compounds 4–6 shown below.

Exemplified compound 4

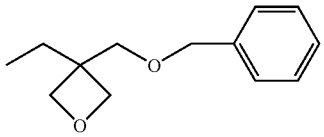

Exemplified compound 5

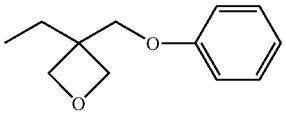

Exemplified compound 6

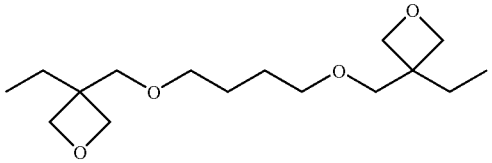

The production method of the compounds having the oxetane ring is not particularly limited, and it may be conducted according to the conventionally known method, and for example, there is a synthetic method of an oxetane ring from diol disclosed by Pattison (D. B. Pattison, J. Am. Chem. Soc., 3455, 79 (1957)).

Further, other than them, compounds having 1–4 oxetane rings, which have high molecular weight of molecular weight of about 1000–5000, are also listed. As an example of them, for example, the following compounds 7–9 are listed.

Exemplified compound 7

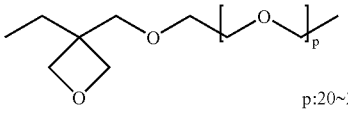

p:20~200

Exemplified compound 8

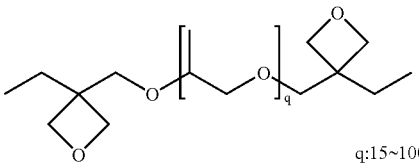

q:15~100

Exemplified compound 9

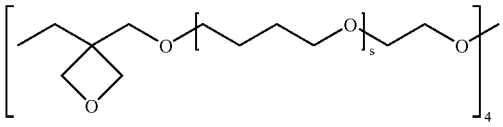

s:20~200

Examples of Cationic polymerizable monomers (hereafter are also referred to as cationic polymerizable photocurable resins) used in the present invention are such as UV curable pre-polymers of epoxy type (UV curable monomer) Examples of UV curable monomers are compounds having at least 2 epoxy groups in the molecule, e.g. alicyclic polyepoxide, polyglycidyl ester of polybasic acid, polyglycidyl ether of polyol, polyglycidyl ether of polyoxyalkylene glycol, polyglycidyl ester of aromatic polyol, polyglycidyl ether of aromatic polyol, urethane polyepoxy compound, and polyepoxy polybutadiene. Each of the aforementioned pre-poylmers can be used solely or mixed with each other.

Other examples of cationic polymerizable monomers incorporated in the cationic polymerizable composition are, (1) styrene derivatives; (2) vinylnaphthalene derivatives; (3) vinyl ethers; and (4) N-vinyl heterocyclic compounds, which are exemplified as below.

(1) styrene Derivatives:

e.g. styrene, p-methylstyrene, p-methoxystyrene, β-methylstyrene, p-methy-β-methylstyrene, α-methylstyrene and p-methoxy-β-methylstyrene.

(2) vinyl naphthalene Derivatives:

e.g. 1-vinylnaphthalene, α-methyl-1-vinylnaphthalene, β-methyl-1-vinylnaphthalene, 4-methyl-1-vinylnaphthalene and 4-methoxy-1-vinylnaphthalene.

(3) vinyl ethers:

e.g. isobutyl vinyl ether, ethyl vinyl ether, phenyl vinyl ether, p-methylphenyl vinyl ether, p-methoxyphenyl vinyl ether, α-methylphenyl vinyl ether, β-methylisobutyl vinyl ether and β-chloroisobutyl vinyl ether.

(4) N-vinyl hetero Compounds e.g. N-vinylcarbazole, N-vinylpyrrolidone, N-vinylindole, N-vinylpyrrole, N-vinylphenothiazine, N-vinylacetoanilide, N-vinylethylacetoamide, N-vinylsuccinimide, N-vinylphthalimide, N-vinylcaprolactam and N-vinylimidazole.

In the present invention, at least one of the epoxy compounds is preferably, an epoxy aliphatic acid ester or an epoxy aliphatic acid glyceride.

Epoxy aliphatic acid esters or epoxy aliphatic acid glycerides used in the present invention are not specifically limited. Compounds having an epoxy group in aliphatic acid esters or aliphatic acid glycerides can be used.

Examples of epoxy aliphatic acid esters are, epoxy oleic acid ester, epoxy methyl stearate, epoxy butyl stearate andepoxy octyl stearate.

Examples of aliphatic acid glycerides are compounds prepared by epoxidization of soybean oil, linseed oil and castor oil. Listed as examples are epoxy soybean oil, epoxy linseed oil and epoxy castor oil and safflower oil.

Other examples are, epoxidized unsaturated aliphatic acid esters, e.g. dicecyl-4,5-epoxytetrahydrophthalate, diisodecyl-4,5-epoxytetrahydrophthalate,didodecyl-4,5-epoxytetrahydrophthalate and compounds epoxidized at a cyclohexene ring such as 1,2-epoxycyclohexene.

The aforementioned epoxy compounds can be used solely or mixed with each other. Among the listed examples, preferably used are epoxidized aliphatic acids such as epoxy soybean oil and epoxy linseed oil.

(Epoxy Compound)

Among epoxy compounds, referable aromatic epoxy compounds are di- or poly-glycidyl ether, which is synthesized by the reaction of polyhydric phenol having at least one aromatic core or alkylene oxide-added polyhydric phenol and epichlorohydrin, and for example, di- or poly-glycidyl ether of bisphenol A or of alkylene oxide-added bisphenol A, di- or poly-glycidyl ether of hydrogenated bisphenol A or of alkylene oxide-added hydrogenated bisphenol A, and novolak type epoxy resin, are listed. Herein, as alkylene oxide, ethylene oxide and propylene oxide are listed.

As alicyclic epoxide, a cyclohexene oxide or cyclopentene oxide, which is obtained by epoxidation of the compound having cycloalkane ring such as at least one cyclohexene or cyclopentene ring by the appropriate oxidant such as hydrogen peroxide or peracid, is preferable.

As a preferable aliphatic epoxide, there is di- or poly-glycidyl ether of aliphatic polyvalent alcohol or of alkylene oxide-added aliphatic polyvalent alcohol, and as its representative example, di-glycidyl ether of alkylene glycol such as di-glycidyl ether of ethylene glycol, di-glycidyl ether of propylene glycol and glycidyl ether of 1,6-hexane diol, poly-glycidyl ether of polyvalent alcohol such as di- or tri-glycidyl ether of glycerin or of alkylene oxide added glycerin, and di-glycidyl ether of polyalkylene glycol such as di-glycidyl ether of polyethylene glycol or of alkylene oxide-added polyethylene glycol, and di-glycidyl ether of polypropylene glycol or of alkylene oxide-added polypropylene glycol, are listed. Herein, as alkylene oxide, ethylene oxide and propylene oxide are listed.

In these epoxides, when the quick hardening ability is considered, aromatic epoxide and alicyclic epoxide are preferable, and particularly, alicyclic epoxide is preferable. In the present invention, on kind of the above epoxides may be solely used, and more than 2 kinds of them may also be used by appropriately being combined.

The photo initiator used the present invention is explained.

As the photo initiator, all publicly known photo acid generators (a compound which generates the acid by the active ray, such as ultraviolet rays) can be used. As the photo acid generator, for example, a chemical amplification type photo resist or compound used for the light cationic polymerization is used (Organic electronics material seminar "Organic material for imaging" from Bunshin publishing house (1993), refer to page 187–192). Examples preferable for the present invention will be listed below.

Firstly, aromatic onium compound $B(C_6F_5)_4^-$, $PF_6^-$, $AsF_6^-$, $SbF_6^-$, $CF_2SO_3^-$ salt, such as diazonium, ammonium, iodonium, sulfonium, phosphonium, can be listed.

Specific examples of the onium compounds will be shown below.

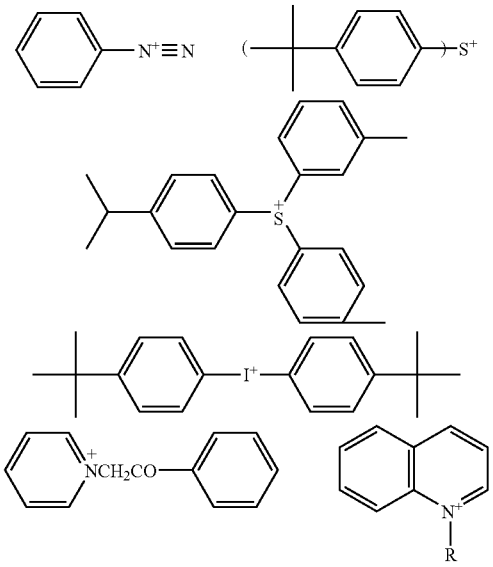

-continued

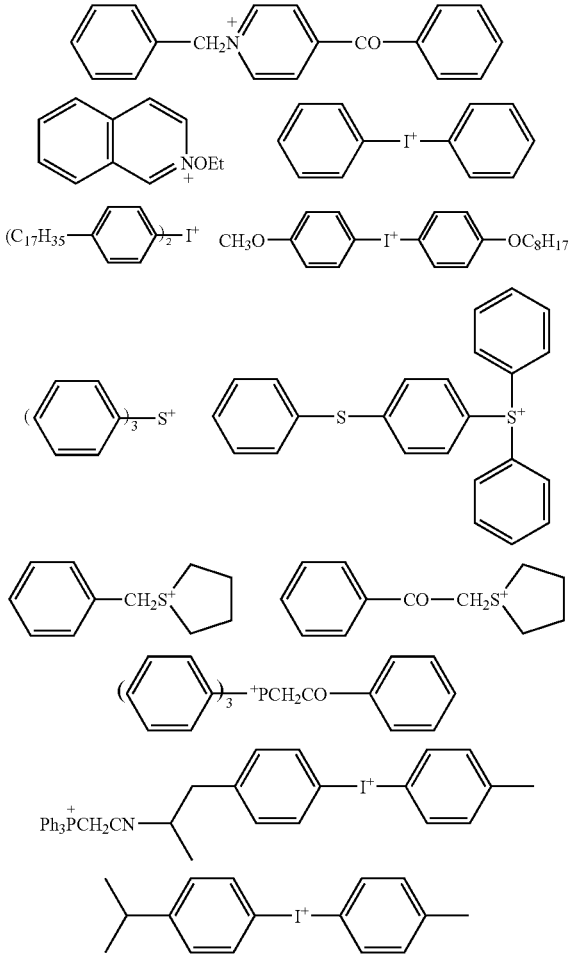

Secondly, sulfone compounds, which generate sulfonic acid, can be listed. Examples of specific compounds will be shown below.

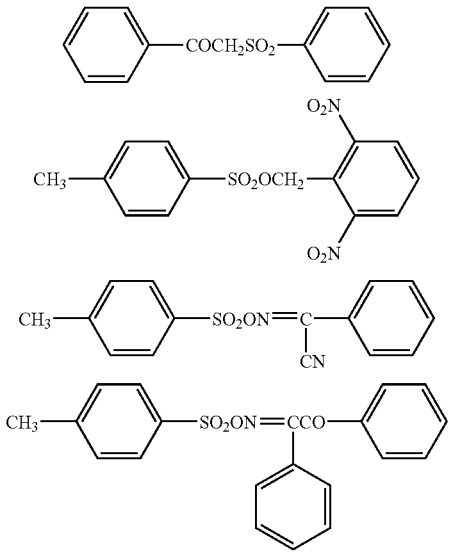

-continued

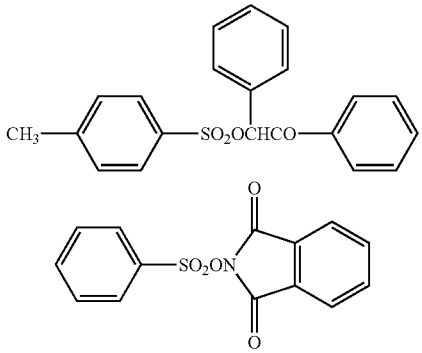

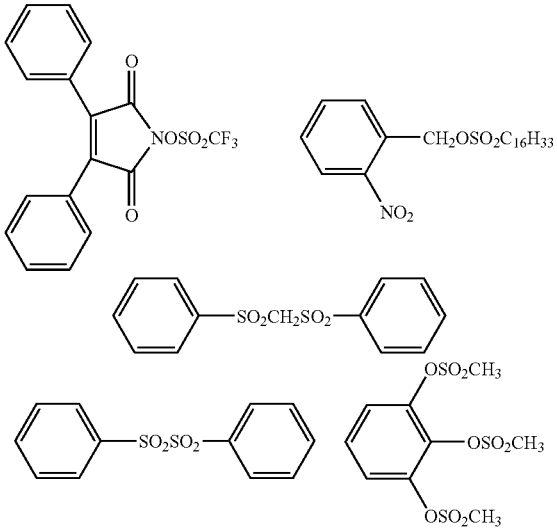

Thirdly, halogenide which generates hydrogen halide can also be used. Examples of specific compounds will be shown below.

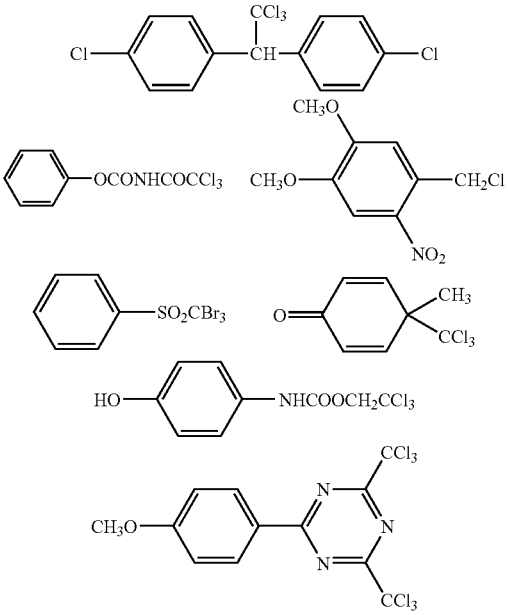

Fourthly, ferrite allene complex can be listed.

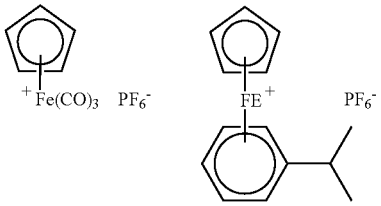

The ink of the present invention preferably contains a photo acid generating agent. Examples of such agents which produce an acid via irradiation of an actinic ray are disclosed in JP-A Nos. 8-248561 and 9-34106. By incorporating a photo acid generating agent, a more stable ink jetting property can be achieved.

The colorants contained in the UV curable ink of the present invention are explained.

As the colorants in the present invention are, the colorants, which can be solved or dispersed in main component of the polymeric compound, can be used, however, from the viewpoint of weather fastness, the pigment is preferable.

As the pigment, the followings can be used for the present invention, however, it is not limited to these.

C.I. Pigment Yellow-1, 3, 12, 13, 14, 17, 81, 83, 87, 95, 109, 42,

C. I. Pigment Orange-16, 36, 38,

C. I. Pigment Red-5, 22, 38, 48:1, 48:2, 48:4, 49:1, 53:1, 57:1, 63:1, 144, 146, 185, 101, C. I. Pigment Violet-19, 23, C. I. Pigment Blue-15:1, 15:3, 15:4, 18, 60, 27, 29, C. I. Pigment Green-7, 36

C. I. Pigment White-6, 18, 21,

C. I. Pigment Black-7.

Further, in the present invention, in order to enhance covering power of color on transparent substrates such as plastic film, it is preferable to use a white ink. Specifically, in soft package printing and label printing, it is preferable to use a white ink. However, since the ejection amount increases, from the viewpoint of the aforesaid ejection stability, and the formation of curling and wrinkling, the amount to be used is obviously limited.

To disperse the pigment, a ball mill, sand mill, attritor, roll mill, agitator, Henschel mixer, colloid mill, ultrasonic homogenizer, Pearl mill, wet jet mill, or paint shaker may be used. Further, when the pigment is dispersed, the dispersing agent can also be added. It is preferable that, as the dispersing agent, high polymeric dispersing agent is used. As the high polymeric dispersing agent, Solsperse series of Avecia co., is cited.

Further, as the dispersion auxiliary agent, the synergist corresponding to each kind of pigment can also be used. It is preferable that 1–50 parts by weight of these dispersing agent and dispersion auxiliary agent are added to 100 parts by weight of the pigment. The dispersion medium is solvent or polymeric compound, and it is preferable that the ultraviolet ray-curable ink used in the present invention comprises no-solvent, because it is reacted and hardened just after the arrival of the ink. When the solvent remains in the hardened image, the problem of deterioration of solvent resistance and VOC (Volatile Organic Compound) of the remained solvent is raised. Accordingly, it is preferable in the dispersion aptitude that the dispersion medium is not solvent, but polymeric compounds, and the monomer in which the viscosity is lowest in them, is selected.

When the dispersion is conducted, it is preferable to configure the pigment, dispersing agent, selection of diluent for the dispersion so that average particle size of the pigment become 0.08–0.5 μm, more preferably 0.3–10 μm, still more preferably, 0.3–3 μm. By this particle size control, the nozzle plugging of the ink-jet head is suppressed, and the preservation stability of the ink, ink transparency and hardening sensitivity can be maintained.

It is preferable for the colorant that the addition amount is 1 weight % to 10 weight % of the whole of the ink.

(The Other Components)

In order to increase the keeping quality of the ink components, the polymerization inhibitor of 200–20000 ppm can be added. Because it is preferable that the ultraviolet ray-curable ink is heated and made to low viscosity, and jetted, it is preferable for preventing the head from plugging by the thermal polymerization that the polymerization inhibitor is added. As the polymerization inhibitor, for example, a basic compound can be added.

Other than the compounds described above, it is possible to use various additives in the actinic radiation curable composition according to the present invention. For example, in order to enhance the storage stability of compositions, it is possible to add polymerization inhibitors in an amount of 2,000–20,000 ppm. It is preferable that an ultraviolet radiation curable ink is ejected while heated to decrease its viscosity. As a result, in order to minimize clogging of head nozzles due to thermal polymerization, it is preferable to add polymerization inhibitors. Other than these, if desired, it is possible to add surface active agents, leveling additives, matting agents, polyester based resins, polyurethane resins, vinyl based resins, acryl based resins, rubber based resins, and wax to adjust physical properties of layers. In order to improve close adhesion properties to recording media, it is effective to add organic solvents in very minute amounts. In such cases, the aforesaid addition is effective in a range in which solvent resistance is not adversely affected and negligible VOC problems occur. The used amount is in the range of 0.1–5 percent and preferably in the range of 0.1–3 percent.

<<Image Forming Method>>

An image forming method, employing the actinic radiation curable resinous composition according to the present invention, will now be described.

A method which is preferred as the image forming method of the present invention is that the aforesaid actinic radiation curable resinous composition is ejected as an ink composition onto a recording material, employing an ink-jet recording system to form images, and subsequently the ink is cured while exposed to actinic radiation such as ultraviolet radiation.

In the present invention, the total ink layer thickness after curing, while ink comprised of the actinic radiation curable resinous composition according to the present invention, is impinged on the recording material and exposed to actinic radiation is preferably 2–20 μm. In the actinic radiation curable ink-jet recording of the screen printing field, at present, the total ink layer thickness usually exceeds 20 μm. In the soft package printing field, in which recording materials are comprised of relatively thin plastic materials, excessive ink ejection, which results in a thick ink layer, is not preferred because problems occur in which stiffness as well as the feeling of quality of the entire printed materials varies, in addition to the aforesaid problems of curling and wrinkling of recording materials.

Incidentally, "total ink layer thickness", as described herein, refers to the maximum value of the ink layer thickness of images formed on recording materials. The aforesaid total layer thickness is applied in the same manner, even though 2-color overprinting (secondary color), 3-color overprinting, or 4-color overprinting (a white ink base) is carried out employing ink-jet recording systems.

Preferred ink ejection conditions are such that the recording head and the ink are heated to 35–100° C. and preferably to 35–80 ° C. to result in stable ejection.

The viscosity of an actinic radiation curable ink varies widely depending on temperature variation. The resulting viscosity variation results in major effects to the liquid droplet size as well as the liquid droplet ejection rate to degrade image quality. As a result, it is necessary to maintain the raised temperature at a constant value. The controlled temperature range of ink temperature is preferably set temperature ±5° C., more preferably set temperature ±2° C., and still more preferably set temperature ±1° C.

Further, in the present invention, the volume of liquid droplets ejected from each nozzle is preferably 2–15 pl.

Originally, in order to form highly detailed images, it is necessary to maintain the volume of liquid droplets in the aforesaid range. However, when the aforesaid volume of a single liquid droplet is ejected, it becomes more difficult to achieve the aforesaid ejection stability. According to the present invention, even though ejection is carried out at a small droplet volume such as 2–15 pl, ejection stability is enhanced, whereby it is possible to consistently form highly detailed images.

In the image recording method employing the actinic radiation curable composition (ink) according to the present invention, actinic radiation is preferably applied between 0.001 and 2.0 seconds after ink impingement and more preferably exposed between 0.001 and 1.0 second. In order to form highly detailed images, it is particularly important that exposure timing is as quick as possible.

Disclosed as an actinic radiation exposure method is a basic method in Japanese Patent Application Open to Public Inspection No. 60-132767. According to the aforesaid patent, light sources are arranged on both sides of a recording head unit, and the recording head as well as the light sources is scanned employing a shuttle system. Exposure is to be performed for a definite time after ink impingement. Further, curing is completed employing another light source which is not driven. U.S. Pat. No. 6,145,979 discloses a method in which optical fibers are employed as an exposure method and in addition, a method in which UV radiation is exposed to a recording section while a collimated radiation is incident to the mirror surface provided on the side surface of a recording head unit. In the image forming method employing the actinic radiation curable composition (ink) according to the present invention, any of these methods are available.

Further, the following method is also one of the preferable embodiments. Actinic radiation exposure is divided into two steps. Initially, while employing the aforesaid method, actinic radiation is exposed between 0.001–2.0 seconds after ink impingement. After completing all printing, further actinic radiation is applied. By dividing actinic radiation exposure into two steps, it is possible to minimize contraction of recording materials which occurs during curing of the ink.

Heretofore, in the UV ink-jet systems, in order to minimize spreading of ink dots as well as bleeding after ink impingement, it is common to use high illuminance light sources which result in a total electric power consumption of at least 1 kW·hr. However, it has been impossible to use such light sources especially for printing on shrink labels due to excessively large contraction of recording materials.

In the present invention, it is further preferable that the total electric power consumption of the light source used for exposure of actinic radiation is less than 1 kW·hr. Examples of light sources resulting in the total electric power consumption of less than 1 kW·hr include, but are not limited, to fluorescent tubes, cold cathode tubes and LEDs. The total electric power consumption is the sum of electric power used to drive light sources and emit radiation. Based on the present invention, by employing minimal electric power as above, it is possible to carry out ink jet recording which results in excellent text quality, minimizes color mixing and makes it possible to very consistently record highly detailed images.

Printed matter which is prepared by employing the actinic radiation curable composition (ink) will now be described.

Printed matter of the present invention is characterized in being prepared by employing the image forming method of the present invention and/or the image forming apparatus described in the present invention, while using non-absorptive recording materials.

"Non-absorptive", as described herein, means that the actinic radiation curable composition (ink) is not absorbed. In the present invention, recording materials which have an ink transfer amount of at most 0.1 ml/mm$^2$ determined by Bristow's method, described below, or substantially 0 ml/mm$^2$ are defined as non-absorptive recording materials.

<<Bristow's Method>>

Bristow's method, as described in the present invention, refers to the method which determines liquid absorption behavior of paper and paper board within a short time. In practice, measurement is performed in accordance to J. TAPPI Paper and Pulp Test Method No. 51–87 Test Method of Liquid Absorption of Paper or Paper Board (Bristow's Method). The resulting liquid absorption is represented by ink transfer amount (ml/m$^2$) within a contact time of 40 milliseconds. Incidentally, in the aforesaid measurement method, pure water (ion exchanged water) is employed. However, in the present invention, in order to more easily discriminate the measured area, water-soluble dyes may be incorporated in an amount of at most 2 percent.

One example of the specific measurement methods will now be described.

The ink transfer amount is measured as follows. A recording medium is allowed to stand at an ambience of 25° C. and 50 percent relative humidity for at least 12 hours. Thereafter, measurement is carried out employing, for example, Bristow Tester Type II (a pressing system), manufactured by Kumagai Riki Kogyo Co., Ltd., which is a dynamic liquid absorbability testing device. In order to enhance measurement accuracy, a commercially available water based ink jet ink (e.g., magenta ink) is employed as the liquid used for the measurement. After the specified contact time, it is possible to determine the ink transfer amount by measuring the area dyed with magenta on the recording medium.

As supports for the present invention, various types of non-absorptive supports can be used other than common coated paper and non-coated paper. Among them, preferably used are non-absorptive plastics and film supports used for soft packaging materials.

Examples of non-absorptive supports are various types of plastic films including PET (polyethylene terephthalate) film, OPS (oriented polystyrene) film, OPP (oriented polypropylene) film, ONy (oriented nylon) film, PVC (polyvinyl chloride) film, PE film, and TAC film. Employed as other plastic films may be polycarbonate, acrylic resins, ABS, acetal, PVA, and rubber. Further, metal and glass may also be employed.

Of these recording materials, when images are formed specifically on PET film, OPS film, OPP film, ONy film, or PVC film which are thermally shrinkable, the effects of the present invention are more pronounced. These substrates tend to curl and deform due to contraction during ink curing and heat generated during the curing reaction. In addition, it is difficult for the ink layer to keep up with contraction of the aforesaid substrate.

The surface energy values of the aforementioned plastic films different from each other. It has been a problem that a dot diameter after ink-jetting varies depending on the recording materials. The preferred composition of the present invention includes OPP film and OPS film having a low surface energy and PET film having a relatively large surface energy. A wide variety of recording materials having a wettability index of 0.035 to 0.06 J/m$^2$ can be used to yield a detailed image. Preferred recording materials for the present invention are those having a wettability index of 0.040 to 0.06 J/m$^2$.

In the present invention, form the viewpoint of the cost of recording materials such as packaging cost as well as production cost, print production efficiency, and compatibility with prints of various sizes, it is more advantageous to used long (web) recording materials.

EXAMPLES

The present invention will now be described below referring to examples, but this invention is not limited to these examples.

Example 1

Preparation of an Ink Composition Set

Each of Ink Composition Sets 1–4 having components described in FIGS. 1–4 was prepared. Further, FIG. 1 indicates Ink Composition Set 1 (being solid ink), FIG. 2 indicates Ink Composition Set 2 (containing a radical polimerizable compound), FIG. 3 indicates Ink Composition Set 3 (containing an oxetane compound), and FIG. 4 indicates Ink Composition Set 4 (containing a 2-substituted oxetane compound) respectively.

TABLE 1

| Ink Composition | | Ink Composition (weight %) | | | | | | |
|---|---|---|---|---|---|---|---|---|
| Set 1 | | Coloring Agent | | | | | | |
| (Comparative Example) | Type of Ink | Type | Added Amount | *A | NaOH | WAX | Behenic acid | Oleic amide |
| | K | Coloring Agent 1 | 4.0 | 0.9 | 0.1 | 40.0 | 35.0 | 20.0 |
| | C | Coloring Agent 2 | 3.0 | 0.9 | 0.1 | 40.0 | 35.0 | 21.0 |
| | M | Coloring Agent 3 | 4.0 | 0.9 | 0.1 | 40.0 | 35.0 | 20.0 |

TABLE 1-continued

| Ink Composition Set 1 (Comparative Example) | Type of Ink | Ink Composition (weight %) Coloring Agent Type | Added Amount | *A | NaOH | WAX | Behenic acid | Oleic amide |
|---|---|---|---|---|---|---|---|---|
| | Y | Coloring Agent 4 | 3.0 | 0.9 | 0.1 | 40.0 | 35.0 | 21.0 |
| | W | Coloring Agent 5 | 12.0 | 0.9 | 0.1 | 40.0 | 25.0 | 22.0 |

TABLE 2

| Ink Composition Set 2 (This Invention) | Type of Ink | Ink Composition (weight %) Coloring Agent Type | Added Amount | Radical Polymerizable Compound A | B | C | Initiator 1 |
|---|---|---|---|---|---|---|---|
| | K | Coloring Agent 1 | 4.0 | 41.0 | 20.0 | 30.0 | 5.0 |
| | C | Coloring Agent 2 | 3.0 | 42.0 | 20.0 | 30.0 | 5.0 |
| | M | Coloring Agent 3 | 4.0 | 41.0 | 20.0 | 30.0 | 5.0 |

TABLE 2-continued

| Ink Composition Set 2 (This Invention) | Type of Ink | Ink Composition (weight %) Coloring Agent Type | Added Amount | Radical Polymerizable Compound A | B | C | Initiator 1 |
|---|---|---|---|---|---|---|---|
| | Y | Coloring Agent 4 | 3.0 | 42.0 | 20.0 | 30.0 | 5.0 |
| | W | Coloring Agent 5 | 12.0 | 33.0 | 20.0 | 30.0 | 5.0 |

TABLE 3

| *1 | Type of Ink | Ink Composition (weight %) Coloring Agent Type | Added Amount | Oxetane Compound 1 | Acid Multiplying Agent | Thermal Base Generating Agent | Photo-induced Acid Generating Agent | Initiator Auxiliary Agent |
|---|---|---|---|---|---|---|---|---|
| | K | Coloring Agent 1 | 4.0 | 87.0 | 1.0 | 2.0 | 5.0 | 1.0 |
| | C | Coloring Agent 2 | 3.0 | 83.0 | 1.0 | 2.0 | 10.0 | 1.0 |
| | M | Coloring Agent 3 | 4.0 | 87.0 | 1.0 | 2.0 | 5.0 | 1.0 |
| | Y | Coloring Agent 4 | 3.0 | 88.0 | 1.0 | 2.0 | 5.0 | 1.0 |
| | W | Coloring Agent 5 | 12.0 | 66.0 | 1.0 | 2.0 | 10.0 | 1.0 |

*1; Ink Composition Set 3 (This Invention)

TABLE 4

| *1 | Type of Ink | Ink Composition (weight %) Coloring Agent Type | Added Amount | Oxetane Compound 2 | Acid Multiplying Agent | Thermal Base Generating Agent | Photo-induced Acid Generating Agent | Initiator Auxiliary Agent |
|---|---|---|---|---|---|---|---|---|
| | K | Coloring Agent 1 | 4.0 | 87.0 | 1.0 | 2.0 | 5.0 | 1.0 |
| | C | Coloring Agent 2 | 3.0 | 83.0 | 1.0 | 2.0 | 10.0 | 1.0 |

TABLE 4-continued

| | Ink Composition (weight %) | | | | | | | |
|---|---|---|---|---|---|---|---|---|
| | Type | Coloring Agent | | | Acid | Thermal Base | Photo-induced Acid | Initiator |
| *1 | of Ink | Type | Added Amount | Oxetane Compound 2 | Multiplying Agent | Generating Agent | Generating Agent | Auxiliary Agent |
| | M | Coloring Agent 3 | 4.0 | 87.0 | 1.0 | 2.0 | 5.0 | 1.0 |
| | Y | Coloring Agent 4 | 3.0 | 88.0 | 1.0 | 2.0 | 5.0 | 1.0 |
| | W | Coloring Agent 5 | 12.0 | 66.0 | 1.0 | 2.0 | 10.0 | 1.0 |

*1; Ink Composition Set 4 (This Invention)

Details of the abbreviated names in Tables 1–4 are as follows.

K: Concentrated Black Ink

C: Concentrated Cyan Ink

M: concentrated Magenta Ink

Y: concentrated Yellow Ink

W: White Ink

Coloring Material 1: C. I. Pigment Black-7

Coloring Material 2: C. I. Pigment Blue-15:3

Coloring Material 3: C. I. Pigment Red-57:1

Coloring Material 4: C. I. Pigment yellow-13

Coloring Material 1: Titanium oxide (being an anatase type, at an average particle diameter of 0.20 μm)

*A: Sodium dimethylsulfosuccinate

Wax: Parafin Wax 155 (produced by NIPPON SEIRO CO., LTD.)

Behenic acid: produced by Wako Pure Chemical Industries, Ltd.

Oleic acid amide: Fatty Acid ON, produced by Kao Corp.

Radical Polymerizable Compound A: Tetraethylene glycol diacrylate

Radical Polymerizable Compound B: ε caprolactam modified erythritol hexaacrylate Radical Polymerizable Compound C: Phenoxethyl methacrylate Initiator 1: Irugacure-907, produced by Ciba Specialty Chemicals, Inc.

Oxetane Compound: OXT 221, produced by TOAGOSEI CO., LTD.

Photo-induced Acid Generating Agent: CS 5102, produced by NIPPON SODA CO., LTD.

Initiator Auxiliary Agent: CI 7001, produced by NIPPON SODA CO., LTD.

Acid Multiplying Agent

Ts:

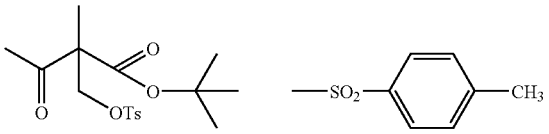

Thermal Base Generating Agent

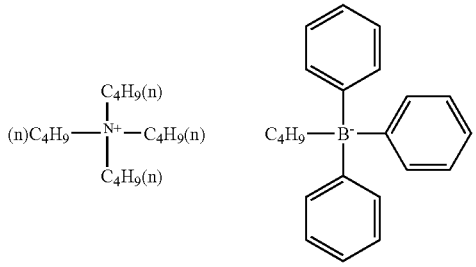

Oxetane Compound 2

Di[2-(4-methoxyphenyl)-3-methyloxetane-3-il]ether

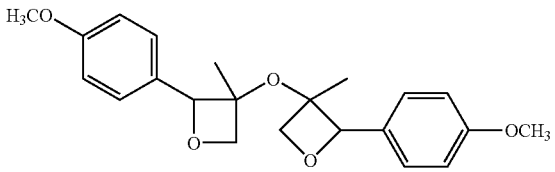

Ink-jet Image Forming Method

Ink-jet Image Recording Apparatus

An ink-jet image recording apparatus described in FIG. 1, provided with piezo-type ink-jet nozzles, was used.

As to the recording head, the following steps were prepared:

(1) providing a predetermined quiescent time between an expansion pulse which functions to expand volume of the ink chambers by deformation actuation of the actuators comprising ink chamber dividing walls as described in detail in foregoing FIGS. 2–10, and a shrinkage pulse which functions to compress the volume of the ink chambers by deformation actuation of actuators;

(2) providing a continuous driving signal generation means for generating multiple driving signals applied to the actuators;

(3) continuously ejecting plural ink droplets from ink nozzles by repeated expansion and compression of ink chamber volume during multiple driving signals from the driving signal generation means;

(4) accompanying the above, preparing an ink-jet recording head setting up quiescent time to decrease the cross talk among the ink chambers adjacent to each other;

(5) setting up the quiescent time between the expansion pulse and the shrinkage pulse so that the time difference between the center of the expansion pulse and the shrinkage pulse equal the ink specific vibration period in each ink chamber;

(6) further providing an ink temperature detecting means to detect ink temperature in the ink chamber; and (7) controlling the quiescent time between the expansion pulse and the shrinkage pulse according to changes of the specific ink vibration period based on ink temperature, utilizing ink temperature detection using this ink temperature detecting means. This was designated as Driving Control Method 1.

Image Printing

Each of the Ink Composition Sets prepared above was loaded into the foregoing ink-jet recording apparatus. Then, image recording was continuously conducted on a long roll of 600 mm in width by 1,000 m in length recording materials, having the surface energy shown in Table 5, to prepare Images 1–12.

Figure 11:
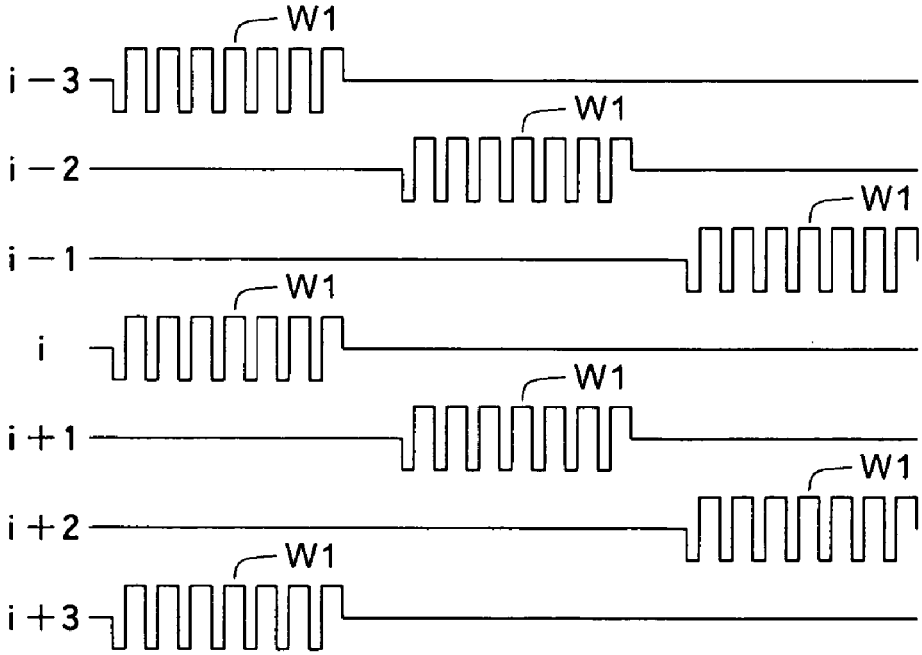
FIG. 11: A figure showing the driving waveforms of the traditional tripartion driving.
Figure 12:
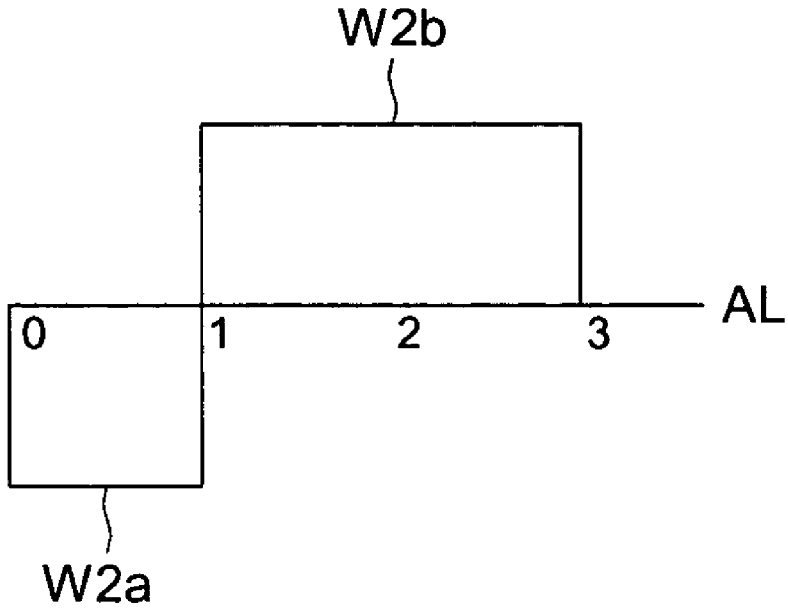
FIG. 12: A schematic figure showing one of the driving pulses of the driving waveforms in FIG. 11.

Further, Images 13–18 were prepared conducting image recording onto recording materials described in Table 5, replacing the above driving signal control method with a method comprising driving waveforms described in FIGS. 11 and 12 (referred to as Driving Control Method 2), using Ink Composition Sets 1 and 4.

Ink supply system comprise ink chambers, supply pipes, anterior chambers of ink chambers adjacent to the head, filtered pipes, and a piezo-head. Insulating from the anterior chambers of ink chambers to the head area, which portion was heated to 120° C. in the case of Ink Composition Set 1, and heated to 50° C. in the case of Ink Composition Sets 2–4. The piezo-head was driven to eject multi-sized dots of 2 pl–15 pl with resolution of 720×720 dpi (dpi indicates dots per inch or 2.54 cm), and each type of ink was continuously ejected. "pl" indicates "picoliter". After 0.5 seconds of ink deposition, curing treatment was conducted under the radiation conditions described in Table 5. After recording, the total ink thickness was measured, and found to be in the range of 2.3–13 μm. Further, evaluation was conducted in place adjusted to temperature of 23° C. and 40% RH.

TABLE 5

| | | | | Radiation Condition | | | | | | | |
|---|---|---|---|---|---|---|---|---|---|---|---|
| | | | | | | | On the Recording Material Surface | | Radiation Light Source Condition | | |
| | Ink | | Driving | Radiation | Radiation Method | | Peak Wave- | Maximum | Peak Wave- | | |
| Image No. | Set No. | Recording Material | Control Method | Light Source | Radiation Position | Light Source | length (nm) | Illuminance (mW/cm$^2$) | length (nm) | Energy (mJ/cm$^2$) | Remarks |
| 1 | 1 | OPP | 1 | A | *1 | *2 | 310 | 8 | 310 | 20 | Comp. |
| 2 | 1 | PET | 1 | A | *1 | *2 | 310 | 8 | 310 | 20 | Comp. |
| 3 | 1 | *3 | 1 | A | *1 | *2 | 310 | 8 | 310 | 20 | Comp. |
| 4 | 2 | OPP | 1 | A | *1 | *2 | 310 | 8 | 310 | 20 | Inv. |
| 5 | 2 | PET | 1 | A | *1 | *2 | 310 | 8 | 310 | 20 | Inv. |
| 6 | 2 | *3 | 1 | A | *1 | *2 | 310 | 8 | 310 | 20 | Inv. |
| 7 | 3 | OPP | 1 | A | *1 | *2 | 310 | 8 | 310 | 20 | Inv. |
| 8 | 3 | PET | 1 | A | *1 | *2 | 310 | 8 | 310 | 20 | Inv. |
| 9 | 3 | *3 | 1 | A | *1 | *2 | 310 | 8 | 310 | 20 | Inv. |
| 10 | 4 | OPP | 1 | A | *1 | *2 | 310 | 8 | 310 | 20 | Inv. |
| 11 | 4 | PET | 1 | A | *1 | *2 | 310 | 8 | 310 | 20 | Inv. |
| 12 | 4 | *3 | 1 | A | *1 | *2 | 310 | 8 | 310 | 20 | Inv. |
| 13 | 4 | OPP | 2 | A | *1 | *2 | 310 | 8 | 310 | 20 | Comp. |
| 14 | 4 | PET | 2 | A | *1 | *2 | 310 | 8 | 310 | 20 | Comp. |
| 15 | 4 | *3 | 2 | A | *1 | *2 | 310 | 8 | 310 | 20 | Comp. |
| 16 | 1 | OPP | 2 | A | *1 | *2 | 310 | 8 | 310 | 20 | Comp. |
| 17 | 1 | PET | 2 | A | *1 | *2 | 310 | 8 | 310 | 20 | Comp. |
| 18 | 1 | *3 | 2 | A | *1 | *2 | 310 | 8 | 310 | 20 | Comp. |

*1; Radiated from both sides of the recording head.
*2; Line Light Source
*3; Bond paper
Comp.; Comparative example
Inv.; This invention Details of the abbreviated names in Table 5 are as follows.

OPP: oriented polypropylene

PET: polyethylene terephthalate

Further, the details of the radiation light sources described in Table 5 are as follows.

Radiation Light Source A: a fluorescent lamp (a custom-made item by NIPPO ELECTRIC CO., LTD., having electrical power consumption of less than 1 kW/hr.).

Evaluation of Ink-jet Recorded Images

Regarding each of images recorded with the foregoing image forming methods, the following evaluation was conducted. Each evaluation was conducted on samples after 1 m, 10 m and 100 m of continuous ejection on the recording materials.

Evaluation of Text Quality

At the target density of each of colors Y, M, C, and K, 6-point MS Ming-style text was printed and jaggedness of text and dot shapes were observed employing a common magnifying glass to evaluate text quality based on the following criteria.

A: No jaggedness was noticed, and the dots were circular.

B: Slight jaggedness was noticed, but dots were circular.

C: Jaggedness was noticed, and the dots were slightly out-of-round, but within the allowable range.

D: Jaggedness was noticeable, and the dots were poor, and beyond the allowable range for practical usage.

Evaluation of Color Mixing (or Bleeding)

At 720 dpi, dots of colors Y, M, C and K were printed adjacent to each other, and each color dot adjacent to others was observed visually employing a loupe, and evaluated for bleeding based on the following criteria.

A: The dots adjacent to each other maintained their circularity, due to no bleeding.

B: The adjacent dots remained nearly circular, exhibiting almost no bleeding

C: Adjacent dots exhibited slight bleeding and dots were slightly deformed, resulting in the lower limit for commercial viability.

D: Adjacent dots exhibited bleeding and mixing, resulting in a commercially unacceptable product.

Evaluation of Creasing and Curling on the Printed Matter

Right after printing at 1 m, 10 m and 100 m, regarding each printed matter, creasing and curling caused by radiation • curing was ovserved visually for evaluation based on the following criteria.

A: No creasing and curling was observed, and the overall result was extremely excellent.

B: Slight creasing and curling was observed, and the overall results were still very good.

C: Minor creasing and curling were observed, but within what is allowable in practice.

D: Servere creasing and curling were observed, resulting in a non-vial product.

Each evaluation result obtained above is shown in Table 6.

TABLE 6

| Sample | 1 m | | | 10 m | | | 100 m | | | |
|---|---|---|---|---|---|---|---|---|---|---|
| No. | *1 | *2 | *3 | *1 | *2 | *3 | *1 | *2 | *3 | Remarks |
| 1 | C | C | D | D | C | D | D | D | D | Comp. |
| 2 | C | C | D | D | C | D | D | D | D | Comp. |
| 3 | C | C | B | D | C | B | D | D | B | Comp. |
| 4 | B | B | B | C | B | B | C | C | C | Inv. |
| 5 | B | B | B | C | B | B | C | C | C | Inv. |
| 6 | B | C | B | C | C | B | C | C | C | Inv. |
| 7 | B | B | B | B | B | B | C | B | B | Inv. |
| 8 | B | B | B | B | B | B | C | B | B | Inv. |
| 9 | B | B | B | C | B | B | C | C | B | Inv. |
| 10 | B | B | B | B | B | B | C | B | B | Inv. |
| 11 | B | B | B | B | B | B | C | B | B | Inv. |
| 12 | B | B | B | C | B | B | C | C | B | Inv. |
| 13 | B | C | B | C | C | B | D | C | B | Comp. |
| 14 | B | C | B | C | C | B | D | C | B | Comp. |
| 15 | B | C | B | C | C | B | D | D | B | Comp. |
| 16 | C | C | D | C | C | D | D | D | D | Comp. |
| 17 | C | C | D | C | C | D | D | D | D | Comp. |
| 18 | C | C | B | C | C | B | D | D | B | Comp. |

*1; Text Quality
*2; Color Mixing
*3; Creasing/curling
Comp.; Comparative Example
Inv.; This Invention From Table 6, it is apparent that the image forming method employing the ink composition sets of the present invention exhibits superiority in text quality, and results in no color mixing and high-definition images, as well as causing no creasing and curling on the printed matter.

Example 2

Ink Composition Sets 5–9 described in Tables 7–11 were respectively prepared. Table 7 shows Ink Composition Set 5 (being solid ink), Table 8 shows Ink Composition Set 6 (ink combined with an epoxy compound and an oxetane compound), Table 9 shows Ink Composition Set 7 (ink combined with an epoxy compound and an oxetane compound), Table 10 shows Ink Composition Set 8 (ink combined with an epoxy compound and an oxetane compound), and Table 11 shows Ink Composition Set 9 (ink combined with an epoxy compound and 2-substituted oxetane compound).

TABLE 7

| Ink Composition | | Ink Composition (weight %) | | | | | | |
|---|---|---|---|---|---|---|---|---|
| Set 5 | | Coloring Agent | | | | | | |
| (Comparative Example) | Type of Ink | Type | Added Amount | *A | NaOH | WAX | Behenic acid | Oleic amide |
| | K | Coloring Agent 1 | 4.0 | 0.9 | 0.1 | 40.0 | 35.0 | 20.0 |
| | C | Coloring Agent 2 | 3.0 | 1.9 | 0.1 | 40.0 | 35.0 | 20.0 |
| | M | Coloring Agent 3 | 4.0 | 0.9 | 0.1 | 40.0 | 35.0 | 20.0 |
| | Y | Coloring Agent 4 | 3.0 | 1.9 | 0.1 | 40.0 | 35.0 | 20.0 |
| | W | Coloring Agent 5 | 12.0 | 0.9 | 0.1 | 32.0 | 35.0 | 20.0 |

TABLE 8

| | Ink Composition (weight %) | | | | | | | |
|---|---|---|---|---|---|---|---|---|
| | Type | Coloring Agent | | | | Thermal Base | Photo-induced Acid | Initiator |
| *1 | of Ink | Type | Added Amount | Oxetane Compound 1 | Epoxy Compound 1 | Generating Agent | Generating Agent | Auxiliary Agent |
| | K | Coloring Agent 1 | 4.0 | 68.0 | 20.0 | 2.0 | 5.0 | 1.0 |
| | C | Coloring Agent 2 | 3.0 | 64.0 | 20.0 | 2.0 | 10.0 | 1.0 |
| | M | Coloring Agent 3 | 4.0 | 68.0 | 20.0 | 2.0 | 5.0 | 1.0 |
| | Y | Coloring Agent 4 | 3.0 | 69.0 | 20.0 | 2.0 | 5.0 | 1.0 |
| | W | Coloring Agent 5 | 20.0 | 47.0 | 20.0 | 2.0 | 10.0 | 1.0 |

*1; Ink Composition Set 6 (This Invention)

TABLE 9

| | Ink Composition (weight %) | | | | | | | | |
|---|---|---|---|---|---|---|---|---|---|
| | Type | Coloring Agent | | | Acid | | Thermal Base | | |
| *1 | of Ink | Type | Added Amount | Oxetane Compound 1 | Multiplying Agent | Epoxy Compound 2 | Generating Agent | *2 | *3 |
| | K | Coloring Agent 1 | 4.0 | 67.0 | 1.0 | 20.0 | 2.0 | 5.0 | 1.0 |
| | C | Coloring Agent 2 | 3.0 | 63.0 | 1.0 | 20.0 | 2.0 | 10.0 | 1.0 |
| | M | Coloring Agent 3 | 4.0 | 67.0 | 1.0 | 20.0 | 2.0 | 5.0 | 1.0 |
| | Y | Coloring Agent 4 | 3.0 | 68.0 | 1.0 | 20.0 | 2.0 | 5.0 | 1.0 |
| | W | Coloring Agent 5 | 20.0 | 46.0 | 1.0 | 20.0 | 2.0 | 10.0 | 1.0 |

*1; Ink Composition Set 7 (This Invention)
*2; Photo-induced Acid Generating Agent
*3; Initi-ator Auxiliary Agent

TABLE 10

| | Ink Composition (weight %) | | | | | | | | |
|---|---|---|---|---|---|---|---|---|---|
| | Type | Coloring Agent | | | Acid | | Thermal Base | | |
| *1 | of Ink | Type | Added Amount | Oxetane Compound 1 | Multiplying Agent | Epoxy Compound 3 | Generating Agent | *2 | *3 |
| | K | Coloring Agent 1 | 4.0 | 67.0 | 1.0 | 20.0 | 2.0 | 5.0 | 1.0 |
| | C | Coloring Agent 2 | 3.0 | 63.0 | 1.0 | 20.0 | 2.0 | 10.0 | 1.0 |
| | M | Coloring Agent 3 | 4.0 | 67.0 | 1.0 | 20.0 | 2.0 | 5.0 | 1.0 |
| | Y | Coloring Agent 4 | 3.0 | 68.0 | 1.0 | 20.0 | 2.0 | 5.0 | 1.0 |
| | W | Coloring Agent 5 | 20.0 | 46.0 | 1.0 | 20.0 | 2.0 | 10.0 | 1.0 |

*1; Ink Composition Set 8 (This Invention)
*2; Photo-induced Acid Generating Agent
*3; Initiator Auxiliary Agent

TABLE 11

| | | Ink Composition (weight %) | | | | | | | |
|---|---|---|---|---|---|---|---|---|---|
| | Type | Coloring Agent | | | Acid | | Thermal Base | | |
| *1 | of Ink | Type | Added Amount | Oxetane Compound 2 | Multiplying Agent | Epoxy Compound 3 | Generating Agent | *2 | *3 |
| | K | Coloring Agent 1 | 4.0 | 67.0 | 1.0 | 20.0 | 2.0 | 5.0 | 1.0 |
| | C | Coloring Agent 2 | 3.0 | 63.0 | 1.0 | 20.0 | 2.0 | 10.0 | 1.0 |
| | M | Coloring Agent 3 | 4.0 | 67.0 | 1.0 | 20.0 | 2.0 | 5.0 | 1.0 |
| | Y | Coloring Agent 4 | 3.0 | 68.0 | 1.0 | 20.0 | 2.0 | 5.0 | 1.0 |
| | W | Coloring Agent 5 | 20.0 | 46.0 | 1.0 | 20.0 | 2.0 | 10.0 | 1.0 |

*1; Ink Composition Set 9 (This Invention)
*2; Photo-induced Acid Generating Agent
*3; Initiator Auxiliary Agent Details of the abbreviated names described in Tables 7–11, except the compounds described in Example 1, are as follow respectively.

Epoxy Compound 1: CELLOXIDE 2021P, produced by DAI CEL CHEMICAL INDUSTRIES, LTD.

Epoxy Compound 2: SANSOCIZER E-4030 (epoxidized fatty acid butyl), produced by New Japan Chemical Co., Ltd.

Epoxy Compound 3: DAIMAC S-300K (epoxidized soybean oil), produced by DAI CEL CHEMICAL INDUSTRIES. LTD.

Ink-jet Image Formation and Evaluation of Images

Regarding each of Ink Composition Sets 5–9 prepared above, image formation was conducted employing Driving Control Method 1 described in Example 1, using radiation conditions and the recording materials described in Table 12, also employing an ink-jet image recording apparatus described in Example 1, insulated from the anterior chamber ink chambers to the head area, which portion was heated to 120° C. in the case of Ink Composition Set 1, and heated to 50+ C. in the case of Ink Composition Sets 2–4. Then, evaluation for each criteria described in Example 1 was conducted.

Further, as a radiation light source, following Radiation Light Source B was employed, and radiation was conducted after 0.1 second of in deposition.

Radiation Light Source B: a cold-cathode tube (being a custom-made article by HYBEC CORPORATION, having an electrical power consumption of less than 1 kW/hr.). Further, thickness became thick for 2.3–19.6 μm due to the usage of white ink. The obtained results are shown in Table 13.

TABLE 12

| | | | | Radiation Condition | | | | | | | |
|---|---|---|---|---|---|---|---|---|---|---|---|
| | | | | | | | On the Recording Material Surface | | Radiation Light Source Condition | | |
| | Ink | | Driving | Radiation | Radiation Method | | Peak Wave- | Maximum | Peak Wave- | | |
| Image No. | Set No. | Recording Material | Control Method | Light Source | Radiation Position | Light Source | length (nm) | Illuminance (mW/cm$^2$) | length (nm) | Energy (mJ/cm$^2$) | Remarks |
| 19 | 5 | OPP | 1 | B | *1 | *2 | 308 | 12 | 308 | 11 | Comp. |
| 20 | 5 | PET | 1 | B | *1 | *2 | 308 | 12 | 308 | 11 | Comp. |
| 21 | 5 | Bond paper | 1 | B | *1 | *2 | 308 | 12 | 308 | 11 | Comp. |
| 22 | 6 | OPP | 1 | B | *1 | *2 | 308 | 12 | 308 | 11 | Inv. |
| 23 | 6 | PET | 1 | B | *1 | *2 | 308 | 12 | 308 | 11 | Inv. |
| 24 | 6 | Bond paper | 1 | B | *1 | *2 | 308 | 12 | 308 | 11 | Inv. |
| 25 | 7 | OPP | 1 | B | *1 | *2 | 308 | 12 | 308 | 11 | Inv. |
| 26 | 7 | PET | 1 | B | *1 | *2 | 308 | 12 | 308 | 11 | Inv. |
| 27 | 7 | Bond paper | 1 | B | *1 | *2 | 308 | 12 | 308 | 11 | Inv. |
| 28 | 8 | OPP | 1 | B | *1 | *2 | 308 | 12 | 308 | 11 | Inv. |
| 29 | 8 | PET | 1 | B | *1 | *2 | 308 | 12 | 308 | 11 | Inv. |
| 30 | 8 | Bond paper | 1 | B | *1 | *2 | 308 | 12 | 308 | 11 | Inv. |
| 31 | 9 | OPP | 1 | B | *1 | *2 | 308 | 12 | 308 | 11 | Inv. |
| 32 | 9 | PET | 1 | B | *1 | *2 | 308 | 12 | 308 | 11 | Inv. |

TABLE 12-continued

| | | | | Radiation Condition | | | | | | | |
|---|---|---|---|---|---|---|---|---|---|---|---|
| | | | | | | | On the Recording Material Surface | | Radiation Light Source Condition | | |
| Image No. | Ink Set No. | Recording Material | Driving Control Method | Radiation Light Source | Radiation Method: Radiation Position | Radiation Method: Light Source | Peak Wave-length (nm) | Maximum Illuminance (mW/cm$^2$) | Peak Wave-length (nm) | Energy (mJ/cm$^2$) | Remarks |
| 33 | 9 | Bond paper | 1 | B | *1 | *2 | 308 | 12 | 308 | 11 | Inv. |

*1; Radiated from both sides of the recording head.
*2; Line Light Sources, 10 pcs.
Comp.; Comparative example Inv.; This invention

TABLE 13

| Sample | 1 m | | | 10 m | | | 100 m | | | |
|---|---|---|---|---|---|---|---|---|---|---|
| No. | *1 | *2 | *3 | *1 | *2 | *3 | *1 | *2 | *3 | Remarks |
| 19 | C | C | D | D | C | D | D | D | D | Comp. |
| 20 | C | C | D | D | C | D | D | D | D | Comp. |
| 21 | C | C | B | D | C | B | D | D | B | Comp. |
| 22 | A | A | A | B | B | B | B | B | B | Inv. |
| 23 | A | A | A | B | B | B | B | B | B | Inv. |
| 24 | A | A | A | B | B | B | B | B | B | Inv. |
| 25 | A | A | A | A | A | B | B | B | B | Inv. |
| 26 | A | A | A | A | A | B | B | B | B | Inv. |
| 27 | A | A | A | B | A | B | B | B | B | Inv. |
| 28 | A | A | A | A | A | A | B | B | B | Inv. |
| 29 | A | A | A | A | A | A | B | B | B | Inv. |
| 30 | A | A | A | A | A | A | B | B | B | Inv. |
| 31 | A | A | A | A | A | A | A | A | A | Inv. |
| 32 | A | A | A | A | A | A | A | A | A | Inv. |
| 33 | A | A | A | A | A | A | A | A | A | Inv. |

*1; Text Quality
*2; Color Mixing
*3; Creasing/Curling
Comp.; Comparative Example
Inv.; This Invention As is apparent from Table 13, it is proved that the image forming method employing the ink composition sets of the present invention exhibit superiority in text quality, and can record no color mixing and high-definition images, as well as causing no creasing and curling on the printed matter.

According to the present invention, it is possible to provide an image forming method, printed matter and an image recording apparatus, which results in images of superior text quality, with no color mixing for high-definition, as well as less creasing curling on printed materials.

What is claimed is:

1. A method for forming an ink-jet image, comprising the steps of:

(a) ejecting droplets of an ink through ink-nozzles of an ink-jet head of an ink-jet recording apparatus, the ink-jet head being provided with:

(i) a plurality of ink chambers having the ink-nozzles, each ink chamber having a dividing wall between adjacent ink chambers, the dividing wall containing an actuator which deforms in response to applied voltages to the adjacent ink chambers; and (ii) a common ink tank which communicates with the ink chambers respectively, the ink-jet recording apparatus being provided with a driving signal generator for continuously generating multiple driving signals applied to the actuator, the driving signal generator producing:

an expansion pulse which expands a volume of the ink chamber by deforming the actuator contained in the dividing wall of the ink chamber;

a shrinkage pulse which compresses the volume of the ink chamber by deforming the actuator; and a predetermined quiescent period between the expansion pulse and the shrinkage pulse, the droplets of the ink being ejected on a recording media from the ink-nozzles by a repeated expansion and shrinking of the ink chamber, and the quiescent period being regulated so as to decrease the cross talk among the ink chambers adjacent to each other, (b) hardening the droplets of the ink ejected on the recording media via irradiation of an actinic ray, wherein a volume of each of the droplets of the ink is between 2 to 15 pl, and the ink contains a radical polymerization monomer and a radical initiator.

2. The method for forming an ink-jet image of claim 1, wherein the predetermined quiescent period between the expansion pulse and the shrinkage pulse is set so that a time difference between a center of the expansion pulses and a center of the shrinkage pulses is equal to a natural vibration period of the ink in the ink chamber.

3. The method for forming an ink-jet image of claim 1, wherein the predetermined quiescent time between the expansion pulse and the shrinkage pulse is controlled based on a change of the ink natural vibration period produced by a change of an ink temperature change, the ink temperature being detected with an ink temperature detector provided in the ink chamber.

4. The method for forming an ink-jet image of claim 1, wherein the actinic ray is an ultraviolet ray.

5. A printed matter produced with the method for forming an ink-jet image of claim 1, wherein a non ink absorptive recording material is employed on which the droplets of the ink are ejected.

6. The method for forming an ink-jet image of claim 1, wherein the ink and the ink-jet head are heated to 35 to 100° C. during ejection of the droplets of the ink.

7. A method for forming an ink-jet image, comprising the steps of:

(a) ejecting droplets of an ink through ink-nozzles of an ink-jet head of an ink-jet recording apparatus, the ink-jet head being provided with:

(i) a plurality of ink chambers having the ink-nozzles, each ink chamber having a dividing wall between adjacent ink chambers, the dividing wall containing an actuator which deforms in response to applied voltages to the adjacent ink chambers; and (ii) a common ink tank which communicates with the ink chambers respectively, the ink-jet recording apparatus being provided with a driving signal generator for continuously generating multiple driving signals applied to the actuator, the driving signal generator producing:

an expansion pulse which expands a volume of the ink chamber by deforming the actuator contained in the dividing wall of the ink chamber;

a shrinkage pulse which compresses the volume of the ink chamber by deforming the actuator; and a predetermined quiescent period between the expansion pulse and the shrinkage pulse, the droplets of the ink being ejected on a recording media from the ink-nozzles by a repeated expansion and shrinking of the ink chamber, and the quiescent period being regulated so as to decrease the cross talk among the ink chambers adjacent to each other, (b) hardening the droplets of the ink ejected on the recording media via irradiation of an actinic ray, wherein the ink contains a cationic polymerization monomer and an acid generating agent.

8. The method for forming an ink-jet image of claim 7, wherein the predetermined quiescent period between the expansion pulse and the shrinkage pulse is set so that a time difference between a center of the expansion pulses and a center of the shrinkage pulses is equal to a natural vibration period of the ink in the ink chamber.

9. The method for forming an ink-jet image of claim 7, wherein the predetermined quiescent time between the expansion pulse and the shrinkage pulse is controlled based on a change of the ink natural vibration period produced by a change of an ink temperature change, the ink temperature being detected with an ink temperature detector provided in the ink chamber.

10. The method for forming an ink-jet image of claim 7, wherein the cationic polymerizable monomer contained in the ink is an oxetane compound or an epoxy compound.

11. The method for forming an ink-jet image of claim 10, wherein the oxetane compound is a compound having an oxetane ring in which the 2-position is substituted.

12. The method for forming an ink-jet image of claim 10, wherein at least one of the epoxy compound is an epoxidized fatty acid ester or an epoxidized fatty acid glyceride.

13. The method for forming an ink-jet image of claim 7, wherein the actinic ray is an ultraviolet ray.

14. A printed matter produced with the method for forming an ink-jet image of claim 7, wherein a non ink absorptive recording material is employed on which the droplets of the ink are ejected.

15. The method for forming an ink-jet image of claim 7, wherein the ink and the ink-jet head are heated to 35 to 100° C. during ejection of the droplets of the ink.

16. An ink-jet recording apparatus for forming an ink-jet image, comprising a head carriage, an ink-jet head, a radiation means and a platen, wherein the ink-jet image is formed by the steps of:

(a) ejecting droplets of an ink through ink-nozzles of the ink-jet head of the ink-jet recording apparatus, the ink-jet head being provided with:

(i) a plurality of ink chambers having the ink-nozzles, each ink chamber having a dividing wall between adjacent ink chambers, the dividing wall containing an actuator which deforms in response to applied voltages to the adjacent ink chambers; and (ii) a common ink tank which communicates with the ink chambers respectively, the ink-jet recording apparatus being provided with a driving signal generator for continuously generating multiple driving signals applied to the actuator, the driving signal generator producing:

an expansion pulse which expands a volume of the ink chamber by deforming the actuator contained in the dividing wall of the ink chamber;

a shrinkage pulse which compresses the volume of the ink chamber by deforming the actuator; and a predetermined quiescent period between the expansion pulse and the shrinkage pulse, the droplets of the ink being ejected on a recording media from the ink-nozzles by a repeated expansion and shrinking of the ink chamber, and the quiescent period being regulated so as to decrease the cross talk among the ink chambers adjacent to each other, (b) hardening the droplets of the ink ejected on the recording media via irradiation of an actinic ray, wherein a volume of each of the droplets of the ink is between 2 to 15 pl, and the ink contains a radical polymerization monomer and a radical initiator.

17. An ink-jet recording apparatus for forming an ink-jet image, comprising a head carriage, an ink-jet head, a radiation means and a platen, wherein the ink-jet image is formed by the steps of:

(a) ejecting droplets of an ink through ink-nozzles of the ink-jet head of the ink-jet recording apparatus, the ink-jet head being provided with:

(i) a plurality of ink chambers having the ink-nozzles, each ink chamber having a dividing wall between adjacent ink chambers, the dividing wall containing an actuator which deforms in response to applied voltages to the adjacent ink chambers; and (ii) a common ink tank which communicates with the ink chambers respectively, the ink-jet recording apparatus being provided with a driving signal generator for continuously generating multiple driving signals applied to the actuator, the driving signal generator producing:

an expansion pulse which expands a volume of the ink chamber by deforming the actuator contained in the dividing wall of the ink chamber;

a shrinkage pulse which compresses the volume of the ink chamber by deforming the actuator; and a predetermined quiescent period between the expansion pulse and the shrinkage pulse, the droplets of the ink being ejected on a recording media from the ink-nozzles by a repeated expansion and shrinking of the ink chamber, and the quiescent period being regulated so as to decrease the cross talk among the ink chambers adjacent to each other, (b) hardening the droplets of the ink ejected on the recording media via irradiation of an actinic ray, wherein the ink contains a cationic polymerization monomer and an acid generating agent.

* * * * *